US009587790B2

(12) United States Patent
Pickard et al.

(10) Patent No.: US 9,587,790 B2
(45) Date of Patent: Mar. 7, 2017

(54) REMOTE LUMIPHOR SOLID STATE LIGHTING DEVICES WITH ENHANCED LIGHT EXTRACTION

(71) Applicant: Cree, Inc., Durham, NC (US)

(72) Inventors: Paul Kenneth Pickard, Acton, CA (US); Nicholas W. Medendorp, Raleigh, NC (US); Kurt S. Wilcox, Libertyville, IL (US)

(73) Assignee: Cree, Inc., Durham, NC (US)

( * ) Notice: Subject to any disclaimer, the term of this patent is extended or adjusted under 35 U.S.C. 154(b) by 544 days.

(21) Appl. No.: 13/834,012

(22) Filed: Mar. 15, 2013

(65) Prior Publication Data

US 2014/0268631 A1 Sep. 18, 2014

(51) Int. Cl.
*F21K 99/00* (2016.01)

(52) U.S. Cl.
CPC . *F21K 9/56* (2013.01); *F21K 9/64* (2016.08)

(58) Field of Classification Search
USPC .... 362/84, 555, 612, 296.01, 341, 609, 623, 362/247, 217.05, 517
See application file for complete search history.

(56) References Cited

U.S. PATENT DOCUMENTS

| | | | |
|---|---|---|---|
| 5,959,316 | A | 9/1999 | Lowery |
| 6,350,041 | B1 | 2/2002 | Tarsa et al. |
| 7,005,679 | B2 | 2/2006 | Tarsa et al. |
| 7,029,935 | B2 | 4/2006 | Negley et al. |
| 7,042,020 | B2 | 5/2006 | Negley |
| 7,070,300 | B2 | 7/2006 | Harbers et al. |
| 7,456,499 | B2 | 11/2008 | Loh et al. |
| 7,564,180 | B2 | 7/2009 | Brandes |
| 7,614,759 | B2 | 11/2009 | Negley |
| 7,663,152 | B2 | 2/2010 | Bierhuizen et al. |
| 7,791,092 | B2 | 9/2010 | Tarsa et al. |
| 7,799,586 | B2 | 9/2010 | Leung et al. |
| 7,800,287 | B2 | 9/2010 | Zheng et al. |
| 7,829,899 | B2 | 11/2010 | Hutchins |
| 2004/0001344 | A1 | 1/2004 | Hecht |
| 2004/0145895 | A1 | 7/2004 | Ouderkirk et al. |
| 2004/0218387 | A1 | 11/2004 | Gerlach |
| 2005/0093430 | A1 | 5/2005 | Ibbetson et al. |
| 2005/0265029 | A1 | 12/2005 | Epstein et al. |
| 2006/0171152 | A1 | 8/2006 | Suehiro et al. |
| 2007/0085103 | A1 | 4/2007 | Nishioka et al. |

(Continued)

FOREIGN PATENT DOCUMENTS

| | | | |
|---|---|---|---|
| AU | 2010269264 | A | 2/2012 |
| JP | 2006/032726 | A | 2/2006 |

(Continued)

*Primary Examiner* — Ashok Patel
(74) *Attorney, Agent, or Firm* — Withrow & Terranova, P.L.L.C.; Vincent K. Gustafson

(57) ABSTRACT

Solid state light emitting devices include lumiphor elements that are spatially segregated from electrically activated solid state emitters with an intermediately arranged optical element (including but not limited to a dichroic filter). Curved or faceted optical elements, and curved or faceted reflectors, may be employed. Multiple solid state emitters may be arranged in multiple reflector cups or recesses. Characteristics of optical elements and/or lumiphor elements of such devices may be varied with respect to angular position.

22 Claims, 9 Drawing Sheets

(56) References Cited

U.S. PATENT DOCUMENTS

| | | | |
|---|---|---|---|
| 2007/0170447 | A1 | 7/2007 | Negley et al. |
| 2007/0223219 | A1 | 9/2007 | Medendorp et al. |
| 2007/0240346 | A1 | 10/2007 | Li et al. |
| 2008/0029720 | A1 | 2/2008 | Li |
| 2008/0037257 | A1 | 2/2008 | Bolta |
| 2008/0117500 | A1 | 5/2008 | Narendran et al. |
| 2008/0192458 | A1 | 8/2008 | Li |
| 2008/0211386 | A1 | 9/2008 | Choi et al. |
| 2008/0218992 | A1 | 9/2008 | Li |
| 2008/0218993 | A1 | 9/2008 | Li |
| 2009/0008573 | A1 | 1/2009 | Conner |
| 2009/0050908 | A1 | 2/2009 | Yuan et al. |
| 2009/0052158 | A1 | 2/2009 | Bierhuizen et al. |
| 2009/0154156 | A1 | 6/2009 | Lo et al. |
| 2009/0250710 | A1 | 10/2009 | Negley |
| 2009/0250714 | A1 | 10/2009 | Yun et al. |
| 2009/0295265 | A1 | 12/2009 | Tabuchi et al. |
| 2010/0027293 | A1 | 2/2010 | Li |
| 2010/0110679 | A1 | 5/2010 | Teng et al. |
| 2010/0177509 | A1 | 7/2010 | Pickard |
| 2011/0157865 | A1* | 6/2011 | Takahashi ..... F21K 9/56 362/84 |
| 2012/0092850 | A1 | 4/2012 | Pickard |
| 2012/0112614 | A1 | 5/2012 | Pickard et al. |
| 2012/0201022 | A1 | 8/2012 | Van de Ven et al. |
| 2013/0229786 | A1 | 9/2013 | Pickard et al. |
| 2013/0258638 | A1* | 10/2013 | Wang ..... H01L 33/505 362/84 |
| 2013/0277643 | A1* | 10/2013 | Williamson ..... H01L 27/156 257/13 |
| 2014/0049965 | A1* | 2/2014 | Aanegola ..... H01L 33/44 362/259 |
| 2015/0228868 | A1* | 8/2015 | Ouderkirck ..... H01L 25/0753 362/84 |
| 2015/0228869 | A1* | 8/2015 | Yoo ..... H01L 33/54 362/97.3 |

FOREIGN PATENT DOCUMENTS

| | | | |
|---|---|---|---|
| JP | 2007/035885 | A | 2/2007 |
| KR | 20100126063 | A | 12/2010 |

* cited by examiner

REMOTE LUMIPHOR SOLID STATE LIGHTING DEVICES WITH ENHANCED LIGHT EXTRACTION

TECHNICAL FIELD

Subject matter herein relates to solid state lighting devices, including devices with remote lumiphors (e.g., lumiphors spatially segregated from electrically activated light emitters), and relates to associated methods of making and using such devices.

BACKGROUND

Lumiphoric materials (also known as lumiphors) are commonly used with electrically activated emitters to produce a variety of emissions such as colored (e.g., non-white) or white light (e.g., perceived as being white or near-white). Electrically activated emitters such as LEDs or lasers may be utilized to provide white light (e.g., perceived as being white or near-white), and have been investigated as potential replacements for white incandescent lamps. Such emitters may have associated filters that alter the color of the light and/or include lumiphoric materials that absorb a portion of emissions having a first peak wavelength emitted by the emitter and re-emit light having a second peak wavelength that differs from the first peak wavelength. Phosphors, scintillators, and lumiphoric inks are common lumiphoric materials. Light perceived as white or near-white may be generated by a combination of red, green, and blue ("RGB") emitters, or, alternatively, by combined emissions of a blue light emitting diode ("LED") and a lumiphor such as a yellow phosphor. In the latter case, a portion of the blue LED emissions pass through the phosphor, while another portion of the blue LED emissions is downconverted to yellow, and the blue and yellow light in combination provide light that is perceived as white. Another approach for producing white light is to stimulate phosphors or dyes of multiple colors with a violet or ultraviolet LED source.

A representative example of a white LED lamp includes a package of a blue LED chip (e.g., made of InGaN and/or GaN) combined with a lumiphoric material such as a phosphor (typically YAG:Ce) that absorbs at least a portion of the blue light (first peak wavelength) and re-emits yellow light (second peak wavelength), with the combined yellow and blue emissions providing light that is perceived as white or near-white in character. If the combined yellow and blue light is perceived as yellow or green, it can be referred to as 'blue shifted yellow' ("BSY") light or 'blue shifted green' ("BSG") light. Addition of red spectral output from an emitter or lumiphoric material (e.g., to yield a "BSY+R" lighting device) may be used to increase the warmth of the aggregated light output and better approximate light produced by incandescent lamps.

Many modern lighting applications require high power emitters to provide a desired level of brightness. High power emitters can draw large currents, thereby generating significant amounts of heat. Conventional binding media used to deposit lumiphoric materials such as phosphors onto emitter surfaces typically degrade and change (e.g., darken) in color with exposure to intense heat. Degradation of the medium binding a phosphor to an emitter surface shortens the life of the emitter structure. When the binding medium darkens as a result of intense heat, the change in color has the potential to alter its light transmission characteristics, thereby resulting in a non-optimal emission spectrum. Limitations associated with binding a lumiphoric material (e.g., a phosphor) to an emitter surface generally restrict the total amount of radiance that can be applied to the lumiphoric material.

In order to increase reliability and prolong useful service life of a lighting device including a lumiphoric material, the lumiphoric material may be physically separated from an electrically activated emitter (e.g., as a 'remote lumiphor' or 'remote phosphor'), such as by coating a lumiphoric material on a light-transmissive carrier or other support element. LED lighting devices incorporating remote phosphors are disclosed, for example, in U.S. Pat. No. 7,234,820 to Harbers et al. and U.S. Patent Application Publication No. 2011.0215700 A1 to Tong et al.

Utilization of a remote lumiphor may also increase system efficiency and/or efficacy. An acknowledged problem with phosphor-converted white LEDs is that yellow light generated at the phosphor on top of the chip is readily absorbed back into the chip. The yellow light (generated by blue light from the LED exciting the phosphor) is omnidirectional—accordingly, just as much yellow light exits the phosphor toward the LED chip as yellow light exits away from the LED. It is estimated that between 15% and 30% of the yellow light originally generated at a phosphor layer may be reabsorbed back into a LED chip, thereby decreasing efficiency and increasing component heating. Use of remote phosphor systems permit increased efficiency. Routinely, in remote phosphor solid state lighting systems, blue LED chips are arranged in a reflective chamber (e.g., a back chamber) with a remote phosphor plate arranged at a light removal region. Because the ratio of absorbing chip area to reflective chamber area is low (typically 1:10, 1:20, or lower) and because the material used for the reflective back chamber is highly reflective (e.g., typically 95-98%) there is a much higher likelihood that yellow light emitted into the back chamber will encounter the reflector than a LED chip. Because reflective back chambers are routinely diffuse white, there is a strong likelihood that any yellow light emitted into the back chamber will make more than one "bounce" before exiting, thereby providing additional opportunities for yellow light to be absorbed into the blue chips. Thus, typical remote phosphor systems, depending on the geometric constraints, tend to provide a 5-10% improvement in system efficacy, without fully overcoming the 15% to 30% reabsorption loss associated with phosphor converted lighting devices not including remote phosphors.

This leaves between 5% and 20% of the yellow light originally emitted from the phosphor continuing to be absorbed. Dichroic filters (arranged between a LED and phosphor) have been suggested as means for allowing transmission of blue light and for reflecting yellow light (that would otherwise be emitted toward the blue LED chips) in a forward direction; however, dichroic filters have a very narrow acceptance angle for incoming light—such that light approaching a dichroic filter at a shallow angle may be reflected rather than transmitted through the filter, even when such light is of a wavelength that would otherwise be transmitted through the dichroic filter. In practice, use of a flat dichroic filter may result in light losses due to unintended blue bounces of sufficient magnitude to nullify any gain in light output attributable to improved yellow light extraction.

LED lighting devices incorporating dichroic filters and remote phosphors are disclosed, for example, in U.S. Pat. No. 7,234,820 to Harbers et al. and U.S. Patent Application Publication No. 2012/0092850 A1 to Pickard.

FIG. 1 is a schematic cross-sectional representation of a conventional lighting device 100 having a lumiphoric material (e.g., yellow phosphor) arranged in or on a lumiphor support element 140 that is spatially segregated from at least one electrically activated emitter 110 (e.g., blue LED). Traditional construction of a lumiphor support element 110 may include a glass disc that is coated with phosphor material (e.g., Calculite or Fortimo from Koninklijke Philips Electronics N.V., Netherlands). The electrically activated emitter(s) 110 are mounted on or over a substrate 101 (e.g., metal core printed circuit board ("MCPCB") or other material for thermal management. Angled side walls 120 extending upward along an emissive surface of the emitter(s) 110 may include a highly reflective (e.g., 98-99% reflective) diffuse white material. An optical element 130 such as a dichroic filter may be placed between the emitter(s) 110 and the lumiphor element (e.g., disc) 140, with an air gap between the emitter(s) 110 and the optical element 130. The optical element 130 is intended to permit passage in a forward direction of emissions (e.g., blue light) generated by the electrically activated emitter(s) 110 and simultaneously reflect any rearward (e.g., yellow) emissions generated by lumiphoric material of the lumiphor element 140. At lateral margins of the optical element, however, a significant fraction of direct emissions generated by the emitter(s) 110 impinging on the optical element at a shallow incident angle may be reflected rearward. As shown in FIG. 1, a light beam that is substantially perpendicular to the optical element 150 is likely to result in a transmitted beam ET, whereas a light beam that impinges on the optical element 150 at a shallow angle far from perpendicular may result in a reflected beam $E_R$ that (at least initially) does not pass through the optical element 150. As a result, light extraction from the device 100 may be reduced.

The art continues to seek improved remote lumiphor lighting devices that address one or more limitations inherent to conventional devices.

SUMMARY

The present invention relates in various aspects to solid state (e.g., LED) lighting devices including lumiphor elements that are spatially segregated from electrically activated solid state emitters, including configurations with optical elements arranged to enhance or otherwise affect light extraction. In certain aspects, curved or faceted optical elements (selected from the group consisting of optical filters and optical reflectors, including dichroic filters) may be employed, optionally in conjunction with curved or faceted reflector elements arranged to direct emissions through the curved or faceted optical elements to stimulate emissions by lumiphoric materials.

In one aspect, the invention relates to a lighting device comprising: at least one electrically activated solid state emitter; at least one lumiphoric material spatially segregated from the at least one electrically activated solid state emitter, and arranged to receive at least a portion of emissions from the at least one electrically activated solid state emitter; at least one optical element, selected from the group consisting of optical filters and optical reflectors, arranged between the at least one electrically activated solid state emitter and the at least one lumiphoric material, wherein at least a portion of the at least one optical element is curved or faceted; and at least one reflector element comprising at least one recess or cup, and arranged to reflect emissions from the at least one electrically activated solid state emitter toward the at least one optical element. In certain embodiments, the at least one optical element may span a solid angle of less than or equal to $2\pi$ steradians.

In another aspect, the invention relates to a lighting device comprising: multiple electrically activated solid state emitter; a lumiphor element spatially segregated from the multiple electrically activated solid state emitter, and arranged to receive at least a portion of emissions from the multiple electrically activated solid state emitter; an optical element, selected from the group consisting of optical filters and optical reflectors, arranged between the multiple electrically activated solid state emitter and the lumiphor element; and at least one reflector element arranged to reflect emissions from the multiple electrically activated solid state emitter toward the optical element; wherein the lighting device comprises at least one of the following features (A) and (B): the optical element comprises a thickness that varies with respect to angular position along at least a portion of the optical element arranged to receive emissions generated by the multiple electrically activated solid state emitter; and the lumiphor element comprises at least one of the following characteristics that varies with respect to angular position along at least a portion of the lumiphor element arranged to receive emissions transmitted through the optical element: (i) thickness of the lumiphor element; (ii) concentration of lumiphoric material; (iii) amount of lumiphoric material; and (iv) composition of lumiphoric material. In certain embodiments, the at least one reflector element may comprise at least one recess or cup.

In another aspect, the invention relates to a lighting device comprising: multiple electrically activated solid state emitters; at least one lumiphor element spatially segregated from the multiple electrically activated solid state emitters, and arranged to receive at least a portion of emissions from the multiple electrically activated solid state emitters; at least one optical element, selected from the group consisting of optical filters and optical reflectors, arranged between the multiple electrically activated solid state emitters and the at least one lumiphor element, wherein at least a portion of the at least one optical element is curved or faceted; and at least one reflector element comprising multiple recesses or cups arranged to reflect emissions from the multiple electrically activated solid state emitters toward the at least one optical element.

In another aspect, the invention relates to a lighting device comprising: at least one electrically activated solid state emitter; a lumiphor element spatially segregated from the at least one electrically activated solid state emitter, comprising at least one lumiphoric material, and arranged to receive at least a portion of emissions from the at least one electrically activated solid state emitter; and at least one optical element, selected from the group consisting of optical filters and optical reflectors, arranged between the at least one electrically activated solid state emitter and the lumiphor element; wherein at least a portion of the at least one optical element is curved or comprises a non-planar shape, and the lumiphor element is substantially planar.

In another aspect, the invention relates to a lighting device comprising: a reflector element; multiple electrically activated solid state emitters; a lumiphor element spatially segregated from the multiple electrically activated solid state emitters, and arranged to receive at least a portion of emissions from the multiple electrically activated solid state emitters; and an optical element, selected from the group consisting of optical filters and optical reflectors, arranged between the multiple electrically activated solid state emitters and the lumiphor element, wherein at least a portion of the optical element is curved or faceted; wherein the lighting device comprises an elongated tubular shape having a length of at least about ten times a width of the lighting device.

In another aspect, the invention relates to a lighting device comprising: a reflector element defining a reflector cavity; at least one electrically activated solid state emitter; at least one lumiphor element spatially segregated from the at least one electrically activated solid state emitter, and arranged to receive at least a portion of light emissions from the at least one electrically activated solid state emitter; and an optical element, selected from the group consisting of optical filters and optical reflectors, arranged between the at least one electrically activated solid state emitter and the at least one lumiphor element, wherein at least a portion of the optical element is curved or faceted; wherein the at least one electrically activated solid state emitter is suspended in or above the reflector cavity and supported by an emitter support element, the at least one electrically activated solid state emitter is arranged to emit light emissions toward the reflector element, and the reflector element is arranged to reflect at least a portion of the light emissions past the emitter support element for transmission through the optical element to interact with the at least one lumiphor element.

In another aspect, the invention relates to a method comprising illuminating an object, a space, or an environment, utilizing a LED device as described herein.

In another aspect, any of the foregoing aspects, and/or various separate aspects and features as described herein, may be combined for additional advantage. Any of the various features and elements as disclosed herein may be combined with one or more other disclosed features and elements unless indicated to the contrary herein.

Other aspects, features and embodiments of the invention will be more fully apparent from the ensuing disclosure and appended claims.

DETAILED DESCRIPTION

Figure 1:
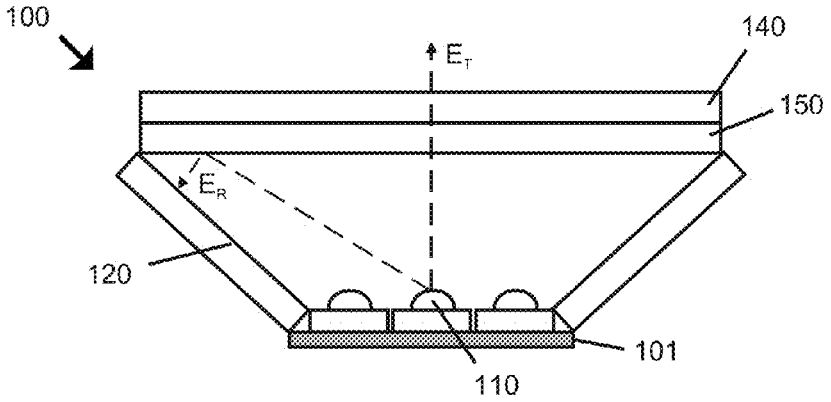
FIG. 1 (RELATED ART)
FIG. 1 is a side cross-sectional schematic view of a conventional solid state lighting device including a phosphor element that is spatially segregated from multiple LEDs, with a dichroic filter arranged between the LEDs and the phosphor element.

As noted previously, the art continues to seek improved lighting devices that address one or more limitations inherent to conventional devices. For example, it would be desirable to provide lumiphor-converted lighting devices permitting an increased proportion of LED emissions to interact with an optical element (selected from an optical filter or optical reflector, such as a dichroic filter) at or near a 90 degree angle of incidence in order to reduce attenuation (e.g., reflection) of such emissions by the optical element, thereby increasing effectiveness (e.g., luminous efficacy and/or energy efficiency) of remote lumiphor lighting devices. It would also be desirable to provide lighting devices with enhanced configuration flexibility, reduced size, extended duration of service, and reduced cost of fabrication.

The present invention relates in various aspects to solid state (e.g., LED) lighting devices including lumiphor elements that are spatially segregated from electrically activated solid state emitters, including configurations with optical elements arranged to enhance or otherwise affect light extraction. In certain aspects, curved or faceted optical elements (selected from the group consisting of optical filters and optical reflectors, including dichroic filters) may be employed, optionally in conjunction with curved or faceted reflector elements arranged to direct emissions through the curved or faceted optical elements to stimulate emissions by lumiphoric materials.

By providing an optical element (selected from optical filters and optical reflector, such as dichroic filters) that is curved or faceted—optionally in conjunction with curved or faceted reflector elements arranged to reflect LED emissions—an increased proportion of LED emissions may interact with an optical element at a large (e.g., at or near a 90 degree) angle of incidence.

Unless otherwise defined, terms used herein should be construed to have the same meaning as commonly understood by one of ordinary skill in the art to which this invention belongs. It will be further understood that terms used herein should be interpreted as having a meaning that is consistent with their meaning in the context of this specification and the relevant art, and should not be interpreted in an idealized or overly formal sense unless expressly so defined herein.

Embodiments of the invention are described herein with reference to cross-sectional, perspective, elevation, and/or plan view illustrations that are schematic illustrations of idealized embodiments of the invention. Variations from the shapes of the illustrations as a result, for example, of manufacturing techniques and/or tolerances, are to be expected, such that embodiments of the invention should not be construed as limited to particular shapes illustrated herein. This invention may be embodied in different forms and should not be construed as limited to the specific embodiments set forth herein. In the drawings, the size and relative sizes of layers and regions may be exaggerated for clarity.

Unless the absence of one or more elements is specifically recited, the terms "comprising," "including," and "having" as used herein should be interpreted as open-ended terms that do not preclude the presence of one or more elements.

It will be understood that when an element such as a layer, region, or substrate is referred to as being "on" another element, it can be directly on the other element or intervening elements may be present. Moreover, relative terms such as "on", "above", "upper", "top", "lower", or "bottom" are used herein to describe one structure's or portion's relationship to another structure or portion as illustrated in the figures. It will be understood that relative terms such as "on", "above", "upper", "top", "lower" or "bottom" are intended to encompass different orientations of the device in addition to the orientation depicted in the figures. For example, if the device in the figures is turned over, structure or portion described as "above" other structures or portions would now be oriented "below" the other structures or portions.

The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials.

Solid state light emitting devices according to embodiments of the invention may include III-V nitride (e.g., gallium nitride) based LED chips or laser chips fabricated on a silicon, silicon carbide, sapphire, or III-V nitride growth substrate, including (for example) devices manufactured and sold by Cree, Inc. of Durham, N.C. Such LEDs and/or lasers may be configured to operate such that light emission occurs through the substrate in a so-called "flip chip" orientation. Such LED and/or laser chips may also be devoid of growth substrates (e.g., following growth substrate removal).

LED chips useable with lighting devices as disclosed herein may include horizontal devices (with both electrical contacts on a same side of the LED) and/or vertical devices (with electrical contacts on opposite sides of the LED). A horizontal device (with or without the growth substrate), for example, may be flip chip bonded (e.g., using solder) to a carrier substrate or printed circuit board (PCB), or wire bonded. A vertical device (without or without the growth substrate) may have a first terminal solder bonded to a carrier substrate, mounting pad, or printed circuit board (PCB), and have a second terminal wire bonded to the carrier substrate, electrical element, or PCB. Examples of vertical and horizontal LED chip structures are disclosed, for example, in U.S. Patent Application Publication No. 2008/0258130 to Bergmann et al. and in U.S. Patent Application Publication No. 2006/0186418 to Edmond et al., the disclosures of which are hereby incorporated by reference herein in their entireties. Although various embodiments shown in the figures may be appropriate for use with vertical LEDs, it is to be appreciated that the invention is not so limited, such that any combination of one or more of the following LED configurations may be used in a single solid state light emitting device: horizontal LED chips, horizontal flip LED chips, vertical LED chips, vertical flip LED chips, and/or combinations thereof, with conventional or reverse polarity Solid state light emitters may be used individually or in groups to emit one or more beams to stimulate emissions of one or more lumiphoric materials (e.g., phosphors, scintillators, lumiphoric inks, quantum dots, day glow tapes, etc.) to generate light at one or more peak wavelength, or of at least one desired perceived color (including combinations of colors that may be perceived as white). Inclusion of lumiphoric (also called 'luminescent') materials in lighting devices as described herein may be accomplished by direct coating on lumiphor support elements or lumiphor support surfaces (e.g., by powder coating, inkjet printing, or the like), adding such materials to lenses, and/or by embedding or dispersing such materials within lumiphor support elements or surfaces. Examples of lumiphoric materials are disclosed, for example, in U.S. Pat. No. 6,600,175 and U.S. Patent Application Publication No. 2009/0184616. Other materials, such as light scattering elements (e.g., particles) and/or index matching materials, may be associated with a lumiphoric material-containing element or surface. LED devices and methods as disclosed herein may include have multiple LEDs of different colors, one or more of which may be white emitting (e.g., including at least one LED with one or more lumiphoric materials). One or more luminescent materials useable in devices as described herein may be down-converting or up-converting, or can include a combination of both types.

Lumiphors may be supported on or within one or more lumiphor support elements, such as (but not limited to) glass layers or discs, optical elements, or layers of similarly substantially translucent or substantially transparent materials capable of being coated with or embedded with lumiphor materials. Lumiphors may be provided in the form of particles films, or sheets. In one embodiment, a lumiphor (e.g., phosphor) is embedded or otherwise dispersed in a body of the lumiphor support element. If a lumiphor is arranged within a lumiphor support element, then lumiphor emissions may be subject to at least partial reflection by (or between) inner and outer surfaces of the lumiphor support element. Anti-reflective coatings or materials may be provided on the inner and/or outer surfaces of the lumiphor support element. In certain embodiment, multiple lumiphor support elements may be arranged across different portions of or an entirety of a light transmissive portion of a lighting device.

A lumiphor support element may be integrated with or supplemented with at least one optical element, including but not limited to an optical filter and/or an optical reflector. In one embodiment, lighting device comprises a dichroic filter disposed between an electrically activated emitter and a lumiphor, and arranged to permit transmission of a first wavelength range but reflect wavelengths of another wavelength range, so as to permit emissions from an electrically activated emitter to be transmitted to a lumiphor, but to outwardly reflect converted emissions generated by the lumiphor, thus preventing lumiphor emissions from being transmitted to (and absorbed by) the electrically activated emitter.

In one embodiment, at least one lumiphor is spatially segregated from and arranged to receive emissions from multiple electrically activated emitters having different peak wavelengths, with the at least one lumiphor providing both wavelength conversion and light diffusion (e.g., mixing) utility. In certain embodiments, one or more diffusing elements may be arranged to receive and diffuse emissions generated by at least one lumiphor.

In certain embodiments, a spatially segregated lumiphor may be arranged to fully cover one or more electrically activated emitters of a lighting device. In certain embodiments, a spatially segregated lumiphor may be arranged to cover only a portion or subset of one or more emitters electrically activated emitters.

In certain embodiment, a lumiphor may be arranged with a substantially constant thickness and/or concentration relative to different electrically activated emitters. In certain embodiments, a lumiphor may be arranged with substantially different thickness and/or concentration relative to different emitters. In one embodiment, a lumiphor is arranged to cover all electrically activated emitters of a lighting device, but with substantially different thickness and/or concentration of lumiphor material proximate to different electrically activated emitters. For example, a lumiphor in the form of a yellow phosphor may be arranged with a greater thickness and/or lumiphor concentration proximate to one or more blue LEDs in order to convert a significant fraction of blue LED emissions to yellow phosphor emissions, but the yellow phosphor may have a reduced (but nonzero) thickness and/or concentration relative to one or more LEDs of different colors (e.g., red and green) to reduce phosphor absorption and increase the amount of light transmitted by the LEDs of different colors, while the presence of the yellow phosphor serves to at least partially diffuse or mix emissions from the different LEDs. The foregoing yellow phosphors may be supplemented by or replaced with phosphors of any desired color, such as red, orange, green, cyan, etc.; similarly, the foregoing electrically activated emitters may be supplemented by or replaced with electrically activated emitters of any desired color(s), including electrically activated emitters in combination with lumiphors.

A lumiphor that is spatially segregated from one or more electrically activated emitters may have associated light scattering particles or elements, which may be arranged with substantially constant thickness and/or concentration relative to electrically activated emitters of different colors, or may be intentionally arranged with substantially different thickness and/or concentration relative to different electrically activated emitters. Multiple lumiphors (e.g., lumiphors of different compositions) may be applied with different concentrations or thicknesses relative to different electrically activated emitters. In one embodiment, lumiphor composition, thickness and/or concentration may vary relative to multiple electrically activated emitters, while scattering material thickness and/or concentration may differently vary relative to the same multiple electrically activated emitters. In one embodiment, at least one lumiphor material and/or scattering material may be applied to an associated support surface by patterning, such may be aided by one or more masks. In one embodiment, one or more lumiphoric material may be deposited directly on or over an optical element such as a dichroic filter.

The term "substrate" as used herein in connection with lighting apparatuses refers to a mounting element on which, in which, or over which multiple solid state light emitters (e.g., emitter chips) may be arranged or supported (e.g., mounted). Exemplary substrates useful with lighting apparatuses as described herein include printed circuit boards (including but not limited to metal core printed circuit boards, flexible circuit boards, dielectric laminates, and the like) having electrical traces arranged on one or multiple surfaces thereof, support panels, and mounting elements of various materials and conformations arranged to receive, support, and/or conduct electrical power to solid state emitters. In certain embodiments, a substrate, mounting plate, or other support element on or over which multiple LED components may be mount may comprise one or more portions of, or all of, a printed circuit board (PCB), a metal core printed circuit board (MCPCB), a flexible printed circuit board, a dielectric laminate (e.g., FR-4 boards as known in the art) or any suitable substrate for mounting LED chips and/or LED packages. In certain embodiments, a substrate may comprise one or more materials arranged to provide desired electrical isolation and high thermal conductivity. In certain embodiments, at least a portion of a substrate may include a dielectric material to provide desired electrical isolation between electrical traces or components of multiple LED sets. In certain embodiments, a substrate can comprise ceramic such as alumina, aluminum nitride, silicon carbide, or a polymeric material such as polyimide, polyester, etc. In certain embodiments, substrate can comprise a flexible circuit board or a circuit board with plastically deformable portions to allow the substrate to take a non-planar (e.g., bent) or curved shape allowing for directional light emission with LED chips of one or more LED components also being arranged in a non-planar manner.

The term "reflective material" as used herein refers to any acceptable reflective material in the art, including (but not limited to) particular MCPET (foamed white polyethylene terephthalate), and surfaces metalized with one or more metals such as (but not limited to) silver (e.g., a silvered surface). MCPET manufactured by Otsuka Chemical Co. Ltd. (Osaka, Japan) is a diffuse white reflector that has a total reflectivity of 99% or more, a diffuse reflectivity of 96% or more, and a shape holding temperature of at least about 160° C. A preferred reflective material would be at least about 90% reflective, more preferably at least about 95% reflective, and still more preferably at least about 98-99% reflective of light of a reflective wavelength range, such as one or more of visible light, ultraviolet light, and/or infrared light, or subsets thereof. A reflector as disclosed herein may include at least one reflective material.

The terms "optical element," "optical filter," or "optical reflector" as used herein refers to any acceptable filter, reflector, or combination thereof used to reflect or filter selected wavelengths of light that may otherwise (i.e., in the absence of such element) be exposed to or emitted from the emitter or lumiphoric material. Optical reflectors may include interference reflectors, and further include dichroic mirrors that reflect certain wavelengths while allowing others to pass through. Optical filters include interference filters, and further include dichroic filters that restrict or block certain wavelengths while allowing others to pass through. Optical reflectors may be used to prevent a substantial amount of light converted by a lumiphoric material from being incident on the electrically activated emitter. In one embodiment, an optical element may include a filter or mirror (e.g., dichroic filter or dichroic mirror) on one face and optionally an anti-reflective coating on the other.

In certain embodiments, one or more LED components can include one or more "chip-on-board" (COB) LED chips and/or packaged LED chips that can be electrically coupled or connected in series or parallel with one another and mounted on a portion of a substrate. In certain embodiments, COB LED chips can be mounted directly on portions of substrate without the need for additional packaging. In certain embodiments, LED components may use packaged LED chips in place of COB LED chips. For example, in certain embodiments, LED components may utilize comprise serial or parallel arrangements of XLamp XM-L High-Voltage (HV) LED packages available from Cree, Inc. of Durham, N.C.

Certain embodiments may involve use of solid state emitter packages. A solid state emitter package may include at least one solid state emitter chip (more preferably multiple solid state emitter chips) that is enclosed with packaging elements to provide environmental protection, mechanical protection, color selection, and/or light focusing utility, as well as electrical leads, contacts, and/or traces enabling electrical connection to an external circuit. One or more emitter chips may be arranged to stimulate one or more lumiphoric materials, which may be coated on, arranged over, or otherwise disposed in light receiving relationship to one or more solid state emitters. A lens and/or encapsulant materials, optionally including lumiphoric material, may be disposed over solid state emitters, lumiphoric materials, and/or lumiphor-containing layers in a solid state emitter package. Multiple solid state emitters may be provided in a single package. In certain embodiments, multiple LEDs within a single LED package or among multiple LED packages may be controlled independently of one another.

In certain embodiments, a light emitting apparatus as disclosed herein (whether or not including one or more LED packages) may include at least one of the following items arranged to receive light from multiple LED components: a single lens; a single optical element; and a single reflector. In certain embodiments, a light emitting apparatus including multiple LED components, packages, or groups may include at least one of the following items arranged to receive light from multiple LEDs: multiple lenses; multiple optical elements; and multiple reflectors. Examples of optical elements include, but are not limited to elements arranged to affect light mixing, focusing, collimation, dispersion, and/or beam shaping.

In certain embodiments, lighting devices or light emitting apparatuses as described herein may include at least one LED with a peak wavelength in the visible range. Multiple LEDs may be provided, and such may be controlled together or independently. In certain embodiments, at least two independently controlled short or medium wavelength (e.g., blue, cyan, or green) LEDs may be provided in a single LED component and arranged to stimulate emissions of lumiphors (e.g., yellow green, orange, and/or red), which may comprise the same or different materials in the same or different amounts or concentrations relative to the LEDs. In certain embodiments, multiple electrically activated (e.g., solid state) emitters may be provided, with groups of emitters being separately controllable relative to one another. In certain embodiments, one or more groups of solid state emitters as described herein may include at least a first LED chip comprising a first LED peak wavelength, and include at least a second LED chip comprising a second LED peak wavelength that differs from the first LED peak wavelength by at least 20 nm, or by at least 30 nm (preferably, but not necessarily, in the visible range). In certain embodiments, solid state emitters with peak wavelengths in the ultraviolet (UV) range may be used to stimulate emissions of one or more lumiphors. Emitters having similar output wavelengths may be selected from targeted wavelength bins. Emitters having different output wavelengths may be selected from different wavelength bins, with peak wavelengths differing from one another by a desired threshold (e.g., at least 20 nm, at least 30 nm, at least 50 nm, or another desired threshold). In certain embodiments, at least one LED having a peak wavelength in the blue range is arranged to stimulate emissions of at least one lumiphor having a peak wavelength in the yellow range.

The expression "peak wavelength", as used herein, means (1) in the case of a solid state light emitter, to the peak wavelength of light that the solid state light emitter emits if it is illuminated, and (2) in the case of a lumiphoric material, the peak wavelength of light that the lumiphoric material emits if it is excited.

In certain embodiments, light emitting apparatuses as disclosed herein may be used as described in U.S. Pat. No. 7,213,940, which is hereby incorporated by reference as if set forth fully herein. In certain embodiments, a combination of light (aggregated emissions) exiting a lighting emitting apparatus including multiple LED components as disclosed herein, may, in an absence of any additional light, produce a mixture of light having x, y color coordinates within an area on a 1931 CIE Chromaticity Diagram defined by points having coordinates (0.32, 0.40), (0.36, 0.48), (0.43, 0.45), (0.42, 0.42), (0.36, 0.38). In certain embodiments, combined emissions from a lighting emitting apparatus as disclosed herein may embody at least one of (a) a color rendering index (CRI Ra) value of at least 85, and (b) a color quality scale (CQS) value of at least 85.

Some embodiments of the present invention may use solid state emitters, emitter packages, fixtures, luminescent materials/elements, power supply elements, control elements, and/or methods such as described in U.S. Pat. Nos. 7,564,180; 7,456,499; 7,213,940; 7,095,056; 6,958,497; 6,853,010; 6,791,119; 6,600,175, 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, and/or 2006/0221272; with the disclosures of the foregoing patents and published patent applications being hereby incorporated by reference as if set forth fully herein.

The expressions "lighting device" and "light emitting apparatus", as used herein, are not limited, except that they are capable of emitting light. That is, a lighting device or light emitting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting, light bulbs, bulb replacements, outdoor lighting, street lighting, security lighting, exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting-work lights, etc., mirrors/vanity lighting, or any other light emitting devices. In certain embodiments, lighting devices or light emitting apparatuses as disclosed herein may be self-ballasted.

The inventive subject matter further relates in certain embodiments to an illuminated enclosure (the volume of which can be illuminated uniformly or non-uniformly), comprising an enclosed space and at least one lighting device or light emitting apparatus as disclosed herein, wherein at least one lighting device or light emitting apparatus illuminates at least a portion of the enclosure (uniformly or non-uniformly).

Reduction of LED attenuation due to dichroic filter losses in remote phosphor systems is particularly useful in systems requiring a large amount of chip area combined with a relatively small lens area, such as high bay light fixtures, indoor or outdoor sporting venue lighting apparatuses, high output downlights, and similar applications.

In certain embodiments, one or more reflectors may be arranged to receive light from one or more electrically activated emitters. An exemplary reflector may include a base and at least one angled wall that may form a cup-like shape. Electrically activated emitters may be mounted on or over a base portion and/or an angled wall portion of a reflector. In one embodiment, an emitter support element may be highly reflective in character prior to mounting of an electrically activated emitter thereon. In another embodiment, an emitter support element may be rendered reflective (such as by application of a reflective material) after the mounting of an electrically activated emitter thereon. In one embodiment, a reflector element may include one or more windows and may be fitted over an emitter support element to permit at least a portion of one or more electrically activated emitters to extend into or through one or more windows defined in the reflector element. In certain embodiments, a reflector surface may be specularly reflective. In certain embodiments, a reflector surface may include a highly reflective (e.g., 98-99% reflective) material. In certain embodiments, a reflector surface may include a highly reflective diffuse white material.

Certain embodiments disclosed herein may utilize curved or faceted optical elements (selected from the group consisting of optical filters and optical reflectors, including dichroic filters). In certain embodiments, such optical elements may be formed by sputtering (deposition) of optically interactive material (i) onto a curved or faceted substrate, or (ii) onto a substantially planar substrate followed by shaping the sputter-deposited substrate into a curved or faceted shape. Preferred sputtering techniques may include ion beam and magnetron sputtering, which may be used to produce dense dielectric films.

In certain embodiments, at least one lumiphoric material of a lighting device is spatially segregated from, and arranged to receive at least a portion of emissions from, at least one electrically activated solid state emitter arranged in or on at least one recess or cup of at least one reflector element. The reflector element(s) may be arranged to reflect emissions from the at least one electrically activated solid state emitter toward at least one optical element (selected from the group consisting of optical filters and optical reflectors, e.g., including dichroic filters), arranged between the at least one electrically activated solid state emitter and the at least one lumiphoric material, wherein at least a portion of the at least one optical element is curved or faceted. The at least one optical element may span a solid angle of less than or equal to $2\pi$ steradians. (A steradian can be defined as the solid angle subtended at the center of a unit sphere by a unit area on its surface, with an entire sphere having a solid angle of $4\pi$ steradians, and a hemisphere having a solid angle of $2\pi$ steradians.) Providing at least one optical element spanning a solid angle of less than or equal to $2\pi$ steradians in conjunction with one or more electrically activated emitters arranged in (e.g., recessed below a top surface of) a reflector cup may beneficially reduce shadowing that would otherwise result along the periphery of an optical element if an optical element having a greater solid angle were employed. In certain embodiments, the at least one reflector element is specularly reflective. In certain embodiments, at least one lumiphoric material or lumiphor-containing element may be disposed in contact with the at least one optical element. In certain embodiments, multiple electrically activated emitters may be provided.

In certain embodiments, at least one lumiphoric material of a lighting device is spatially segregated from, and arranged to receive at least a portion of emissions from, multiple electrically activated solid state emitter arranged in proximity to at least one reflector element. The at least one reflector element may be arranged to reflect emissions from the multiple electrically activated solid state emitter toward an optical element (selected from the group consisting of optical filters and optical reflectors, e.g., including dichroic filters) arranged between the multiple electrically activated solid state emitter and the at least one lumiphoric material. The lighting device may include at least one of (and optionally both of) the following features (A) and (B): (A) the optical element comprises a thickness that varies with respect to angular position along at least a portion of the optical element arranged to receive emissions generated by the multiple electrically activated solid state emitter; and (B) the lumiphor element comprises at least one of the following characteristics that varies with respect to angular position along at least a portion of the lumiphor element arranged to receive emissions transmitted through the optical element: (i) thickness of the lumiphor element; (ii) concentration of lumiphoric material; (iii) amount of lumiphoric material; and (iv) composition of lumiphoric material. In certain embodiments, the at least one reflector element may comprise at least one recess or cup. In certain embodiments, at least a portion of the optical element is curved or faceted. In embodiments, at least one reflector element may include multiple recesses or cups arranged to reflect emissions from the multiple electrically activated solid state emitters toward the optical element, wherein different emitters may be arranged in, on, or proximate to different reflector cups or recesses. In certain embodiments, at least a portion of at least one reflector element is curved or faceted. In certain embodiments, the at least one reflector element is specularly reflective. Optionally, a diffuser element may be arranged to diffuse emissions generated by electrically activated solid state emitters and the lumiphor element.

In certain embodiments, at least one lumiphor element is spatially segregated from, and arranged to receive emissions from, multiple electrically activated solid state emitters of a lighting device. At least one optical element (selected from the group consisting of optical filters and optical reflectors, including dichroic filters) is arranged between the multiple electrically activated solid state emitters and the at least one lumiphor element, wherein at least a portion of the at least one optical element is curved or faceted. At least one reflector element including multiple recesses or cups is arranged to reflect emissions from the multiple electrically activated solid state emitters toward the at least one optical element. In certain embodiments, at least a portion of the at least one optical element may be faceted. In certain embodiments, multiple optical element may be provided, including a first optical element arranged to receive emissions from a first electrically activated solid state emitter arranged in a first recess or cup of the at least one reflector element, and including a second optical element arranged to receive emissions from a second electrically activated solid state emitter arranged in a second recess or cup of the at least one reflector element. In certain embodiments, multiple lumiphor elements may be provided, including a first lumiphor element arranged to be stimulated by emissions of a first electrically activated solid state emitter arranged in a first recess or cup of the at least one reflector element, and including a second lumiphor element arranged to be stimulated by emissions of a second electrically activated solid state emitter arranged in a second recess or cup of the at least one reflector element. In certain embodiments, the at least one reflector element is specularly reflective. In certain embodiments, a diffuser may be arranged to diffuse emissions generated by the multiple electrically activated solid state emitters and the at least one lumiphor element.

In certain embodiments, a lighting device may include at least one lumiphor element spatially segregated from, and arranged to receive at least a portion of light emissions from, at least one electrically activated solid state emitter that is suspended in or above a reflector cavity of a reflector element and supported by an emitter support element. The at least one electrically activated solid state emitter is arranged to emit light emissions toward the reflector element, and the reflector element is arranged to reflect at least a portion of the light emissions past the emitter support element for transmission through the optical element to interact with the at least one lumiphor element. In certain embodiments, at least a portion of the reflector element is faceted. In certain embodiments, the lumiphor element is disposed in contact with the optical element. In certain embodiments, the optical element comprises a dichroic filter. In certain embodiments, the reflector element is specularly reflective. In certain embodiments, the lighting device may comprise a light bulb or light fixture.

In certain embodiments, a lighting device may include a curved or faceted (non-planar) optical element in combination with a substantially planar lumiphor element. According to such an embodiment, a lighting device may include at least one electrically activated solid state emitter, and a lumiphor element that is spatially segregated from the at least one electrically activated solid state emitter. The lumiphor element may include at least one lumiphoric material, and be arranged to receive at least a portion of emissions from the at least one electrically activated solid state emitter. At least one optical element, selected from the group consisting of optical filters and optical reflectors (e.g., such as a dichroic filter), may be arranged between the at least one electrically activated solid state emitter and the lumiphor element; wherein at least a portion of the at least one optical element is curved or comprises a non-planar shape, and the lumiphor element is substantially planar. A gap may be provided between the at least one optical element and that lumiphor element.

In certain embodiments, a lighting device may include a curved or nonplanar optical element and an elongated tubular shape, with length to width ratio of at least about 5:1, 8:1, 10:1, 12:1, 15:1, 20:1, or another desired ratio. Such a device may include a reflector element; multiple electrically activated solid state emitters; a lumiphor element that is spatially segregated from the multiple electrically activated solid state emitter and that is arranged to receive at least a portion of emissions from the multiple electrically activated solid state emitters; and an optical element (selected from the group consisting of optical filters and optical reflectors), arranged between the multiple electrically activated solid state emitters and the lumiphor element.

Various illustrative features are described below in connection with the accompanying figures.

Figure 2:
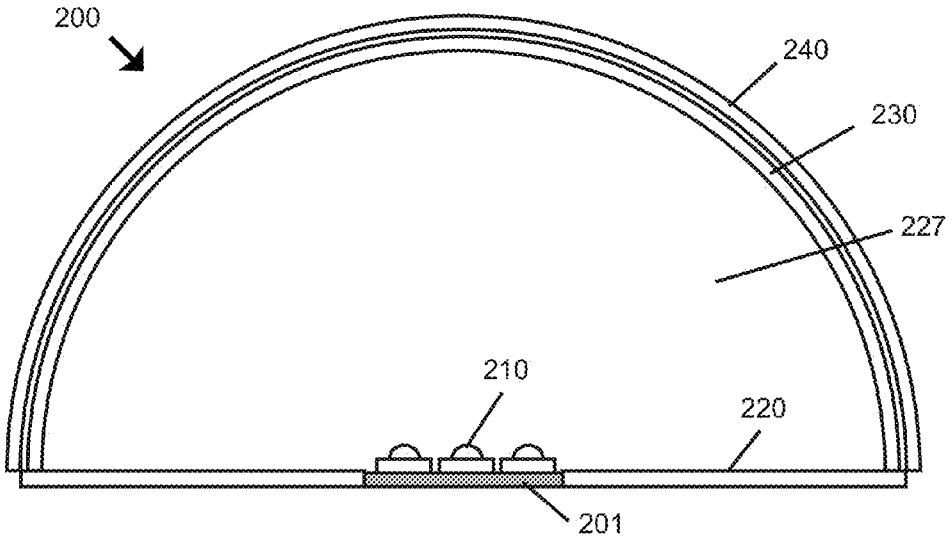
FIG. 2 is a side cross-sectional schematic view of a solid state lighting device according to one embodiment, including a multiple LEDs proximate to a substantially planar reflective surface and arranged to transmit light through a hemispheric optical element (e.g., optical filter or optical reflector, such a dichroic filter) to stimulate at least one lumiphoric material that is spatially segregated from the LEDs.

FIG. 2 illustrates a solid state lighting device 200 according to one embodiment, including solid state emitters (e.g., LEDs) 210 supported by a substrate 201 and arranged proximate to a reflector element 220. An optical element 230 (selected from the group consisting of optical filters and optical reflectors, including dichroic filters) and a lumiphor element 240 are spatially separated from the emitters 210. In certain embodiments, such separation includes an intervening gap 227 devoid of (e.g., solid or liquid) material; in other embodiments, an encapsulant or other material may be provided within the gap 227. Although the optical element 230 and lumiphor element 240 are shown as being slightly separated in FIG. 2, in certain embodiments, these elements 230, 240 may be arranged in contact with one another or integrated into a single component. The optical element 230 and lumiphor element 240 illustrated in FIG. 2 are hemispheric.

Figure 3:
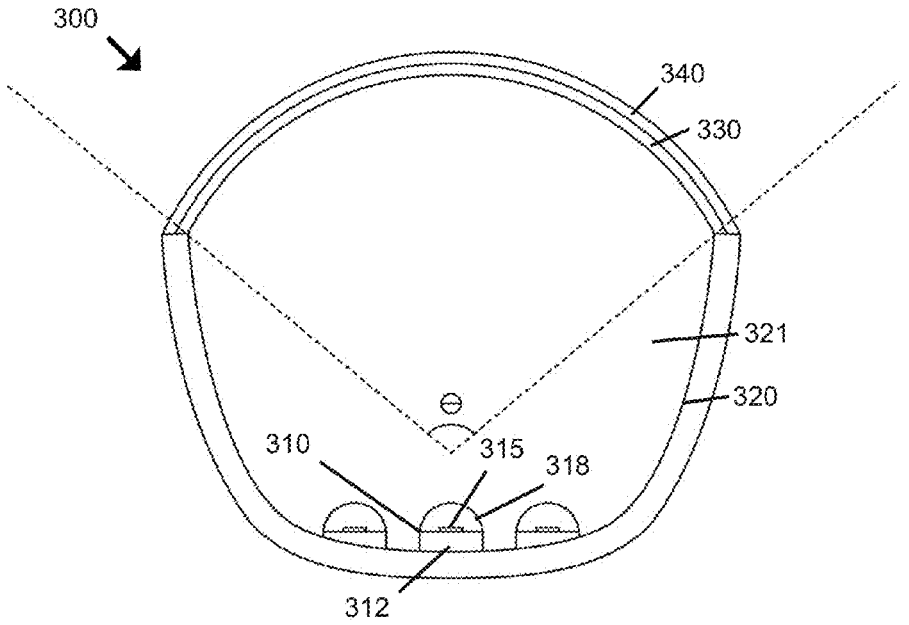
FIG. 3 is a side cross-sectional schematic view of a solid state lighting device according to one embodiment, including multiple LEDs arranged in or on a curved reflector element and arranged to transmit light through a curved optical element (e.g., optical filter or optical reflector, such a dichroic filter) to stimulate at least one lumiphoric material contained in a lumiphor element that is spatially segregated from the LEDs.

FIG. 3 illustrates a solid state lighting device 300 according to one embodiment, including multiple solid state emitters 310 arranged in or on a cup-shaped curved reflector element 320 defining a recess 321. The solid state emitters 310 illustrated in FIG. 3 may embody emitter packages, each separately including a substrate 312, LED chip 315, and encapsulant or lens 318 that may serve a first optical element. An optical element 330 (selected from the group consisting of optical filters and optical reflectors, including dichroic filters) and a lumiphor element 340 are spatially separated from the emitters 310, and cover the emissive end of the reflector element 320. Positioning of the emitters 310 (e.g., emitter packages) in the recess 321 of a cup-shaped reflector element 320 may cause an increased fraction of emissions to be directed toward the optical element 330 at a steep (closer to 90 degree) angle in order to reduce reflective losses through the optical element 330. As shown in FIG. 3, the optical element 330 is substantially smaller than hemispheric (i.e., having a solid angle substantially less than $2\pi$ steradians). The depth, shape, and angle of opening ($\Theta$) of the reflector element 320, and the size, shape and conformation of the optical element 330, may be adjusted to promote increase transmission of light through the optical element. Such parameters may be optimized relative to dimensional constraints to achieve desired output for a specific end use application.

Figure 4A:
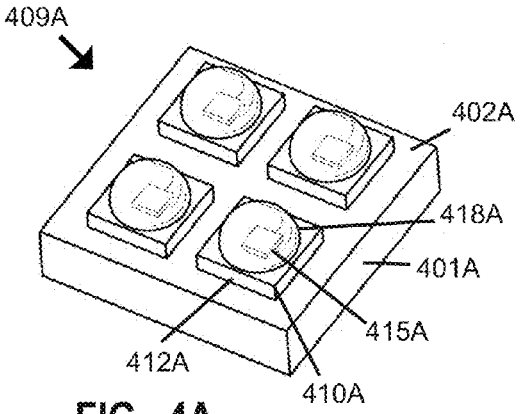
FIG. 4A is a perspective view of an emitter subassembly 409A useable with various lighting devices disclosed herein.

FIG. 4A is a perspective view of an emitter subassembly 409A useable with various lighting devices disclosed herein. The emitter subassembly 409A includes multiple LED packages 410A arranged over a top (e.g., planar) surface 402A of an emitter support element 401A, with each LED package 410A including a body 412A, a LED chip 415A, and a lens or encapsulant 418A. Any suitable number of packages 410A may be provided in or on the emitter support element 401A.

Figure 4B:
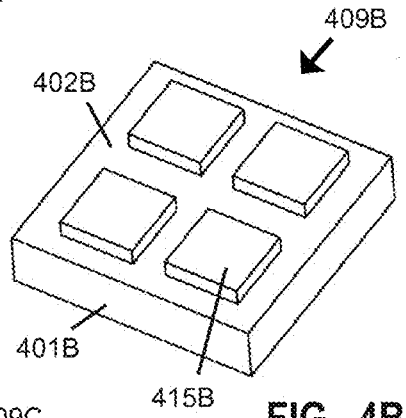
FIG. 4B is a perspective view of an emitter subassembly including multiple unpackaged LED chips arranged over an emitter support element, with the emitter subassembly being useable with a lighting device according to various embodiments.

FIG. 4B is a perspective view of an emitter subassembly 409B useable with various lighting devices disclosed herein. The emitter subassembly 409B includes multiple LED chips 415B arranged over a top (e.g., planar) surface 402B of an emitter support element 401B. Any suitable number of chips 415B may be provided in or on the emitter support element 401B.

Figure 4C:
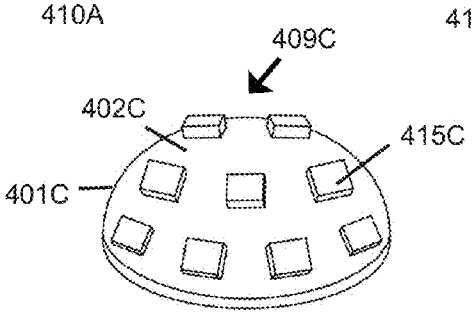
FIG. 4C is a perspective view of an emitter subassembly including multiple LED chips arranged over a non-planar emitter support element, with the emitter subassembly being useable with a lighting device according to various embodiments.

FIG. 4C is a perspective view of an emitter subassembly 409C useable with various lighting devices disclosed herein. The emitter subassembly 409C includes multiple LED chips 415C arranged over a curved (e.g., convex) surface 402C of an emitter support element 401C. Any suitable number of chips 415C may be provided in or on the emitter support element 401C.

Figure 5:
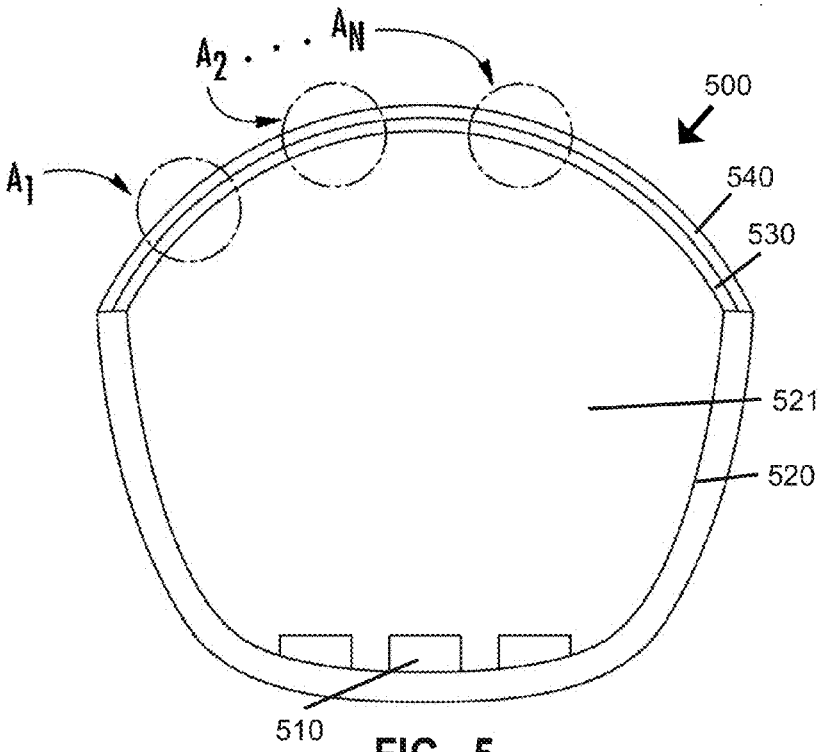
FIG. 5 is a side cross-sectional schematic view of a solid state lighting device according to one embodiment, including multiple LEDs arranged in or on a curved reflector element and arranged to transmit light through a curved optical element (e.g., optical filter or optical reflector, such a dichroic filter) to stimulate at least one lumiphoric material contained in a lumiphor element that is spatially segregated from the LEDs, with at least one of the optical element and the lumiphor element including characteristics that vary with respect to angular position.

FIG. 5 illustrates a solid state lighting device 500 according to one embodiment, including multiple solid state emitters (e.g., LEDs) 510 arranged in or on a cup-shaped curved reflector element 520 defining a recess 521. An optical element 530 (selected from the group consisting of optical filters and optical reflectors, including dichroic filters) and a lumiphor element 540 are spatially separated from the emitters 510, and cover the emissive end of the reflector element 520, with the optical element 530 arranged between the lumiphor element 540 and the emitters 510. Positioning of the emitters 510 in the recess 521 of a cup-shaped reflector element 520 may cause an increased fraction of emissions to be directed toward the optical element 530 at a steep (closer to 90 degree) angle in order to reduce reflective losses through the optical element 330. Providing at least one optical element spanning a solid angle of less than or equal to $2\pi$ steradians in conjunction with one or more electrically activated emitters arranged in (e.g., recessed below a top surface of) a reflector cup may beneficially reduce shadowing that would otherwise result along the periphery of an optical element if an optical element having a greater solid angle were employed.

As shown in FIG. 5, multiple regions $A_1$, $A_2$, $A_N$ (wherein N represents an arbitrary number, since it is to be understood that any suitable number of regions could be provided) are arranged along the light-transmissive boundary of the cavity 521, wherein the regions $A_1$, $A_2$, $A_N$ correspond to areas where the optical element 530 and/or the lumiphor element 540 include characteristics that vary with respect to angular position. Such variation in characteristics may include at least one of the following features (A) and (B): (A) the optical element includes a thickness that varies with respect to angular position (i.e., along at least a portion of the optical element arranged to receive emissions generated by the at least one electrically activated solid state emitter); and (B) the lumiphor element comprises at least one of the following characteristics that varies with respect to angular position (i.e., along at least a portion of the lumiphor element arranged to receive emissions transmitted through the optical element): (i) thickness of the lumiphor element; (ii) concentration of lumiphoric material; (iii) amount of lumiphoric material; and (iv) composition of lumiphoric material. Within feature (A), any one or more of the subfeatures (i) to (iv) may be varied. In certain embodiments, both feature variations (A) and (B) may be provided. Variations in characteristics of an optical element and a lumiphor element are described in further detail in connection with FIGS. 6A-6E.

Figure 6A:
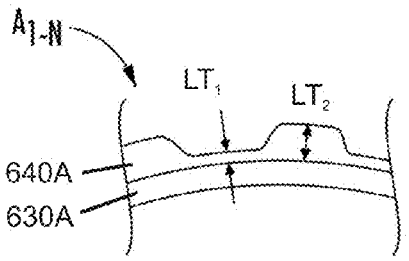
FIG. 6A is a side cross-sectional schematic view of portions of the optical element and lumiphor element of FIG. 5 according to one embodiment, showing variation of thickness of the lumiphor element with respect to angular position.

FIG. 6A is a side cross-sectional schematic view of portions (corresponding to regions $A_1$, $A_2$, $A_N$ of FIG. 5) of an optical element 630A and lumiphor element 640A (corresponding to regions $A_1$, $A_2$, $A_N$ of FIG. 5) according to one embodiment, showing variation of thickness of the lumiphor element 640A with respect to angular position. In particular, a first reduced lumiphor thickness region $LT_1$ is illustrated proximate to a second increased lumiphor thickness region $LT_2$. As illustrated in FIG. 6A, each of the optical element 630A and lumiphor element 640A includes at least one curved surface.

Figure 6B:
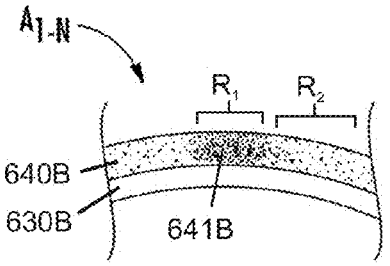
FIG. 6B is a side cross-sectional schematic view of portions of the optical element and lumiphor element of FIG. 5 according to one embodiment, showing variation of concentration or amount of lumiphoric material in the lumiphor element with respect to angular position.

FIG. 6B is a side cross-sectional schematic view of portions (corresponding to regions $A_1$, $A_2$, $A_N$ of FIG. 5) of an optical element 630B and lumiphor element 640B (corresponding to regions $A_1$, $A_2$, $A_N$ of FIG. 5) according to one embodiment, showing variation of concentration or amount of lumiphoric material (e.g., lumiphoric material particles 641B) in the lumiphor element 640B with respect to angular position. In particular, a first region $R_1$ of the lumiphor element 640B with increased lumiphor concentration and/or amount is illustrated proximate to a second region $R_2$ of the lumiphor element 640B with decreased lumiphor concentration and/or amount. Regions of increased lumiphor concentration may be achieved, for example, by selective deposition or injection of lumiphoric material on, over, or in a lumiphor support element. As illustrated in FIG. 6B, each of the optical element 630B and lumiphor element 640B includes multiple curved surfaces.

Figure 6C:
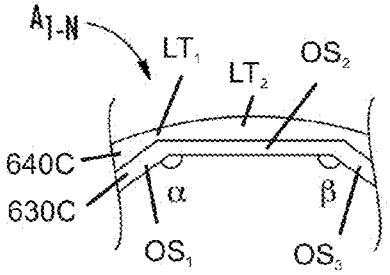
FIG. 6C is a is a side cross-sectional schematic view of portions of the optical element and lumiphor element of FIG. 5 according to one embodiment, showing variation of thickness of the lumiphor element with respect to angular position, and showing the optical element as including multiple facets or non-coplanar segments joined along edges thereof.

FIG. 6C is a is a side cross-sectional schematic view of portions (corresponding to regions $A_1$, $A_2$, $A_N$ of FIG. 5) of an optical element 630C and lumiphor element 640C (corresponding to regions $A_1$, $A_2$, $A_N$ of FIG. 5) according to one embodiment, showing variation of thickness of the lumiphor element with respect to angular position, and showing the optical element 630C as including multiple facets or non-coplanar segments $OS_1$, $OS_2$, and $OS_3$ joined along edges thereof. The lumiphor element 640C further includes variation in thickness, including regions $LT_1$ having reduced thickness and regions $LT_2$ having increased thickness. Angles between adjacent facets or non-coplanar segments are shown in FIG. 6C as $\alpha$ (between optical element segments $OS_1$ and $OS_2$) and $\beta$ (between optical segments $OS_2$ and $OS_3$). In certain embodiments, $\alpha$ is substantially equal to $\beta$; in other embodiments, $\alpha$ and $\beta$ may be unequal. As illustrated in FIG. 6C, only the lumiphor element 640C includes a curved surface.

Figure 6D:
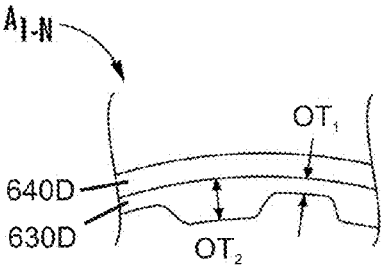
FIG. 6D is a side cross-sectional schematic view of portions of the optical element and lumiphor element of FIG. 5 according to one embodiment, showing variation of thickness of the optical element with respect to angular position.

FIG. 6D is a side cross-sectional schematic view of portions (corresponding to regions $A_1$, $A_2$, $A_N$ of FIG. 5) of an optical element 630D and lumiphor element 640D according to one embodiment, showing variation of thickness of the optical element 630D with respect to angular position In particular, the optical element 630D includes a first increased thickness optical element region $OT_1$ adjacent to a second decreased thickness optical element region $OT_2$. As illustrated in FIG. 6D, each of the optical element 630D and lumiphor element 640D includes at least one curved surface.

Figure 6E:
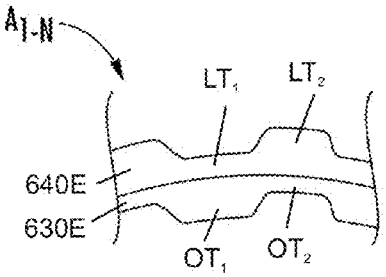
FIG. 6E is a side cross-sectional schematic view of portions of the optical element and lumiphor element of FIG. 5 according to one embodiment, showing variation of thickness of the lumiphor element and variation of thickness of the optical element with respect to angular position.

FIG. 6E is a side cross-sectional schematic view of portions (corresponding to regions $A_1$, $A_2$, $A_N$ of FIG. 5) of an optical element 630E and lumiphor element 640E according to one embodiment, showing variation of thickness of the lumiphor element 640E and variation of thickness of the optical element 630E with respect to angular position. The optical element 630 A includes a first increased thickness optical element region $OT_1$ and a second reduced thickness optical element region $OT_2$. The lumiphor element includes a first reduced thickness lumiphor element region $LT_1$ and a second increased thickness lumiphor element region $LT_2$. As shown in FIG. 6E the first increased thickness optical element region $OT_1$ may correspond in angular position to the first reduced thickness lumiphor element region $LT_1$ (with the second reduced thickness optical element region $OT_2$ corresponding in angular position to the second increased thickness lumiphor element region $OT_2$). In certain embodiments, one or more increased thickness portions of each of the lumiphor element 640E and optical element 630E may correspond in angular position, and one or more reduced thickness portions of each of the lumiphor element 640E and optical element 630E may correspond in angular position. As illustrated in FIG. 6E, each of the optical element 630E and lumiphor element 640E includes at least one curved surface (i.e., along the interface between the optical element 630E and lumiphor element 640E).

Figure 6F:
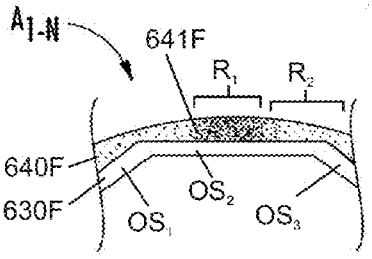
FIG. 6F is a side cross-sectional schematic view of portions of the optical element and lumiphor element of FIG. 5 according to one embodiment, showing variation of concentration or amount of lumiphoric material in the lumiphor element with respect to angular position, showing variation of thickness of the lumiphor element, and showing the optical element as including multiple facets or non-coplanar segments joined along edges thereof.

FIG. 6F is a side cross-sectional schematic view of portions (corresponding to regions $A_1$, $A_2$, $A_N$ of FIG. 5) of an optical element 640F and lumiphor element 640F according to one embodiment, showing variation of concentration or amount of lumiphoric material (e.g., lumiphoric material particles 641F) in the lumiphor element 640F with respect to angular position. In particular, a first region $R_1$ of the lumiphor element 640B with increased lumiphor concentration and/or amount (and also including increased layer thickness) is illustrated proximate to a second region $R_2$ of the lumiphor element 640B with decreased lumiphor concentration and/or amount (and also including reduced layer thickness. The optical element 630F includes multiple facets or non-coplanar segments $OS_1$, $OS_2$, $OS_3$ joined along edges thereof. As illustrated in FIG. 6F, only the lumiphor element 640F (but not the optical element 630F) includes a curved surface.

Figure 7:
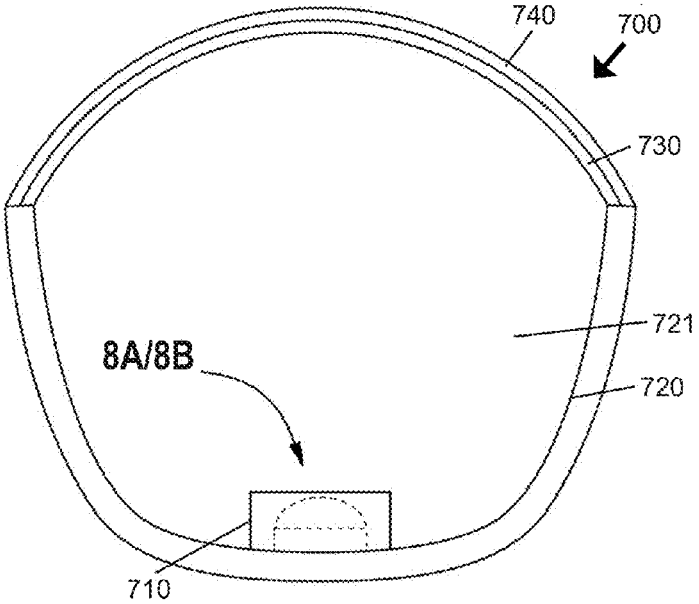
FIG. 7 is a side cross-sectional schematic view of a solid state lighting device according to one embodiment, including at least one LED or emitter subassembly arranged in or on a curved reflector element and arranged to transmit light through a curved optical element (e.g., optical filter or optical reflector, such a dichroic filter) to stimulate at least one lumiphoric material contained in a lumiphor element that is spatially segregated from the at least one LED or emitter subassembly.

FIG. 7 is a side cross-sectional schematic view of a solid state lighting device 700 according to one embodiment, including at least one LED or emitter subassembly 710 arranged in or on a curved reflector element 720 and arranged to transmit light through a curved optical element 730 (e.g., optical filter or optical reflector, such a dichroic filter) to stimulate at least one lumiphoric material contained in a lumiphor element 740 that is spatially segregated from the at least one LED or emitter subassembly 710. Emissions generated by the LED or emitter subassembly 710 may be transmitted through a reflector cavity (e.g., which may be devoid of solid material) and transmitted through the optical element 730 to impinge on the lumiphoric element 740, wherein at least a portion of the emissions are absorbed by and stimulate emissions of lumiphoric material. At least a portion of the emissions generated by at least one LED or emitter subassembly 710 may exit the lighting device 700 without absorption by lumiphoric material of the lumiphor element 740. The optical element 730 preferably serves to reduce or prevent lumiphor-converted emissions from being transmitted into the reflector cavity 721, by reflecting such emissions in an outward direction to exit the lighting device 700. It is to be appreciated that any suitable type of at least one LED or emitter subassembly 710 may be used, including (but not limited to) the subassemblies illustrated in FIGS. 8A-8B. In certain embodiments, multiple emitter subassemblies may be arranged in a single reflector cavity (e.g., cavity 721) and/or arranged to emit light to impinge on a single optical element and lumiphor element (e.g., optical element 730 and lumiphor element 740).

Figure 8A:
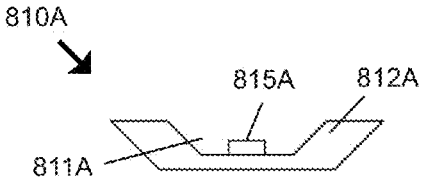
FIG. 8A is a side cross-sectional schematic view of an emitter subassembly including at least one LED arranged over a reflector, with the emitter subassembly being useable with a lighting device according to various embodiments disclosed herein.

FIG. 8A illustrates an emitter subassembly 810A including at least one LED 815A arranged over a reflector 812A defining a cavity 811A, with the emitter subassembly 810A being useable with lighting devices according to various embodiments disclosed herein. As illustrated in FIG. 8A, in certain embodiments the reflector cavity 811A may be uncovered and/or devoid of solid material. In other embodiments, at least a portion of the reflector cavity may be covered and/or at least partially filled with a material (e.g., encapsulant, lens, etc.).

Figure 8B:
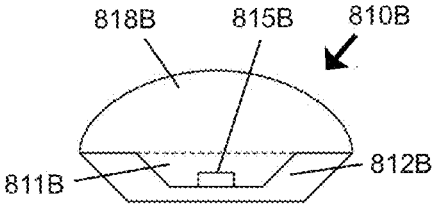
FIG. 8B is a side cross-sectional schematic view of an emitter subassembly including at least one LED arranged over a reflector and including a light affecting element arranged over the reflector, with the emitter subassembly being useable with a lighting device according to various embodiments disclosed herein.

FIG. 8B illustrates another an emitter subassembly 810B including at least one LED 815B arranged over a reflector 812B defining a cavity 811B and including a light affecting element 818B (e.g., encapsulant, lens, etc.) arranged in, on or over the reflector cavity 811B, with the emitter subassembly 810B being useable with lighting devices according to various embodiments disclosed herein.

Figure 9A:
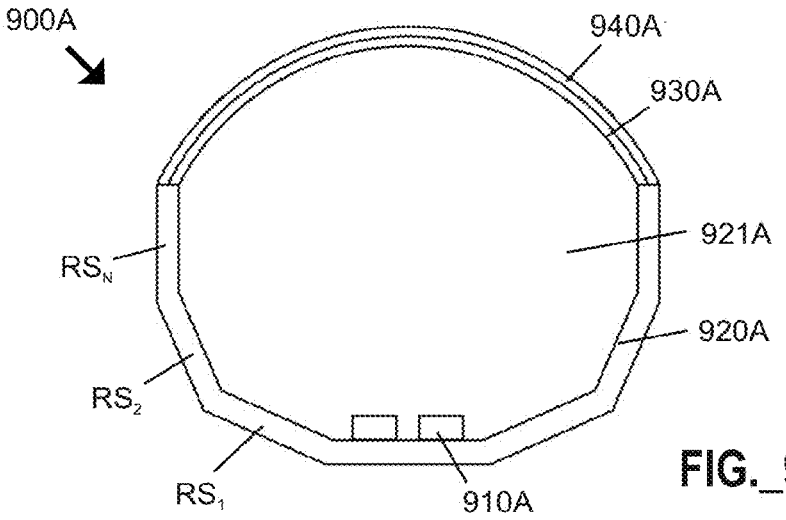
FIG. 9A is a side cross-sectional schematic view of a solid state lighting device according to one embodiment, including multiple LEDs arranged in or on a faceted reflector element and arranged to transmit light through a curved optical element (e.g., optical filter or optical reflector, such a dichroic filter) to stimulate at least one lumiphoric material contained in a lumiphor element that is spatially segregated from the LEDs.
Figure 9B:
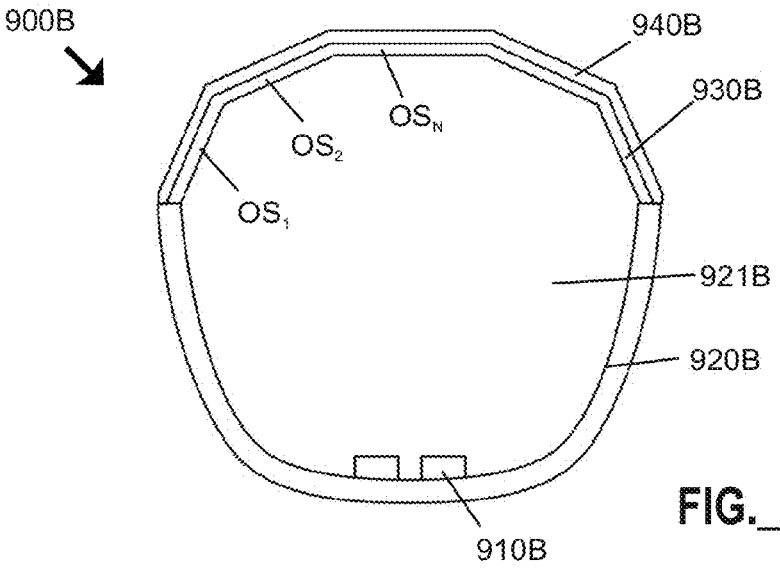
FIG. 9B is a side cross-sectional schematic view of a solid state lighting device according to one embodiment, including multiple LEDs arranged in or on a curved reflector element and arranged to transmit light through a faceted optical element (e.g., optical filter or optical reflector, such a dichroic filter) to stimulate at least one lumiphoric material contained in a lumiphor element that is spatially segregated from the LEDs.
Figure 9C:
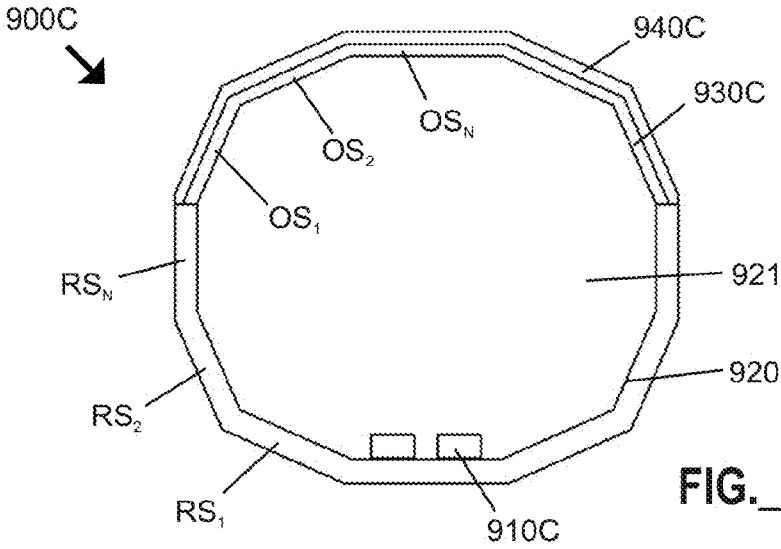
FIG. 9C is a side cross-sectional schematic view of a solid state lighting device according to one embodiment, including multiple LEDs arranged in or on a faceted reflector element and arranged to transmit light through a faceted optical element (e.g., optical filter or optical reflector, such a dichroic filter) to stimulate at least one lumiphoric material contained in a lumiphor element that is spatially segregated from the LEDs.

Various combinations of curved or faceted reflector elements may be used in combination with curved or faceted optical elements according to different embodiments of the invention, as shown in connection with FIGS. 9A-9C.

FIG. 9A illustrates at least a portion of a solid state lighting device 900A according to one embodiment, including multiple LEDs 910A arranged in or on a faceted reflector element 920A that defines a cavity or recess 921B containing the LEDs 910A. Emissions from the LEDs 910A are emitted and/or reflected in a direction toward a curved optical element 930A (e.g., optical filter or optical reflector, such a dichroic filter) covering at least a portion of the reflector cavity 921A. Emissions that are transmitted through the optical element 930A impinge on at least one lumiphoric material contained in a curved lumiphor element 940A that is spatially segregated from the LEDs 910A. The optical element 930A is preferably arranged to prevent or reduce emissions from the at least one lumiphoric material from being transmitted into the reflector cavity 921A, and instead to reflect such emissions in an outward direction to exit the lighting device 900A.

FIG. 9B illustrates at least a portion of a solid state lighting device 900B according to one embodiment, including multiple LEDs 910B arranged in or on a curved reflector element 920A that defines a cavity or recess 921B containing the LEDs 910B. Emissions from the LEDs 910B are emitted and/or reflected in a direction toward a faceted optical element 930B (e.g., optical filter or optical reflector, such a dichroic filter) covering at least a portion of the reflector cavity 921B. Emissions that are transmitted through the optical element 930B impinge on at least one lumiphoric material contained in a faceted lumiphor element 940B that is spatially segregated from the LEDs 910B. The optical element 930A is preferably arranged to prevent or reduce emissions from the at least one lumiphoric material from being transmitted into the reflector cavity 921B, and instead to reflect such emissions in an outward direction to exit the lighting device 900B.

FIG. 9C illustrates at least a portion of a solid state lighting device 900C according to one embodiment, including multiple LEDs 910C arranged in or on a faceted reflector element 920C that defines a cavity or recess 921C containing the LEDs 910C. Emissions from the LEDs 910C are emitted and/or reflected in a direction toward a faceted optical element 930C (e.g., optical filter or optical reflector, such a dichroic filter) covering at least a portion of the reflector cavity 921C. Emissions that are transmitted through the optical element 930C impinge on at least one lumiphoric material contained in a faceted lumiphor element 940C that is spatially segregated from the LEDs 910*c*. The optical element 930A is preferably arranged to prevent or reduce emissions from the at least one lumiphoric material from being transmitted into the reflector cavity 9210, and instead to reflect such emissions in an outward direction to exit the lighting device 900C.

In certain embodiments, multiple LEDs may be arranged in multiple reflector cups and arranged to transmit light through a single optical element (e.g., optical filter or optical reflector, such a dichroic filter) to stimulate at least one lumiphoric material contained in a lumiphor element that is spatially segregated from the LEDs. In certain embodiments, the single optical element may be curved or faceted.

Figure 10:
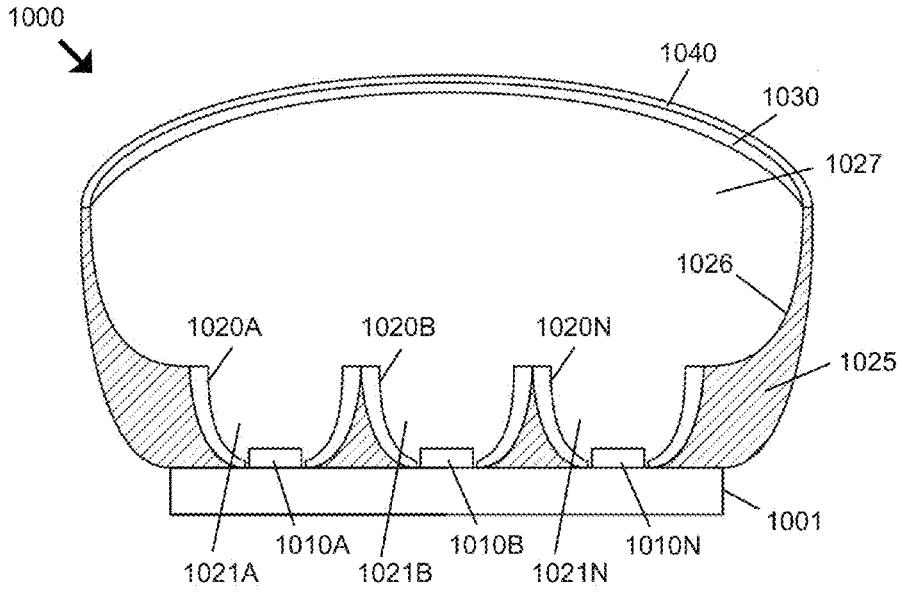
FIG. 10 is a side cross-sectional schematic view of a solid state lighting device according to one embodiment, including multiple LEDs arranged in multiple reflector cups and arranged to transmit light through a single curved optical element (e.g., optical filter or optical reflector, such a dichroic filter) to stimulate at least one lumiphoric material contained in a lumiphor element that is spatially segregated from the LEDs.

FIG. 10 illustrates a solid state lighting device 1000 including multiple LEDs 1010A, 1010B, 1010N arranged in or on multiple reflector cups 1020A, 1020B, 1020N defining multiple reflector cavities 1021A, 1021B, 1021N. The LEDs 1010A, 1010B, 1010N may be supported by a substrate 1001. The reflector cups 1020A, 1020B, 1020N may be defined in a single body structure 1025 that may optionally be pre-manufactured (e.g., by molding, optionally followed by surface coating) and fitted over the substrate 1001 (e.g., following mounting of LEDs 1010A, 101B, 101N to the substrate 1001). In various embodiments, the reflector cups 1020A, 1020B, 1020N may be of the same size and shape; in other embodiments, the size and/or shape of individual reflector cups 1020A, 1020B, 1020N may be varies relative to one another. The body structure 1026 may include at least one secondary reflective structure or surface 1026 (e.g., above and/or around the reflector cups 1020A, 1020B, 1020N) to enclose at least a portion of a cavity 1027. A (preferably curved or faceted) optical element 1030 (e.g., optical filter or optical reflector, such a dichroic filter) may be arranged over at least a portion of the cavity 1027, and arranged between the cavity 1027 and a (preferably curved or faceted) lumiphor element 1040 including at least one lumiphoric material arranged to be stimulated by emissions of at least one of the LEDs 1010A, 1010B, 1010N. In operation, of the device 1000, emissions from the LEDs 1010A, 1010B, 1010N are emitted (and reflected by the reflector cups 1020A, 1020B, 1020N) into the cavity 1027 in a direction toward the optical element 1030 covering at least a portion of the reflector cavity 1021. The secondary reflective structure or surface 1026 may reflect additional emissions (e.g., internal reflected emissions) toward the optical element 1030. Emissions that are transmitted through the optical element 1030 impinge on at least one lumiphoric material contained in the lumiphor element 1040, which is spatially segregated from the LEDs 1010. The optical element 1030 is preferably arranged to prevent or reduce emissions from the at least one lumiphoric material from being transmitted into the reflector cavity 1021, and instead to reflect such emissions in an outward direction to exit the lighting device 1000.

In certain embodiments, multiple LEDs may be arranged in multiple reflector cups and arranged to transmit light through multiple curved optical elements (e.g., optical filter or optical reflector, such a dichroic filter) to stimulate at least one lumiphoric material contained in multiple lumiphor elements that are spatially segregated from the LEDs, and including a diffuser or secondary optical element arranged to receive emissions of the multiple lumiphor elements. In certain embodiments, the multiple optical elements may be curved or faceted.

Figure 11:
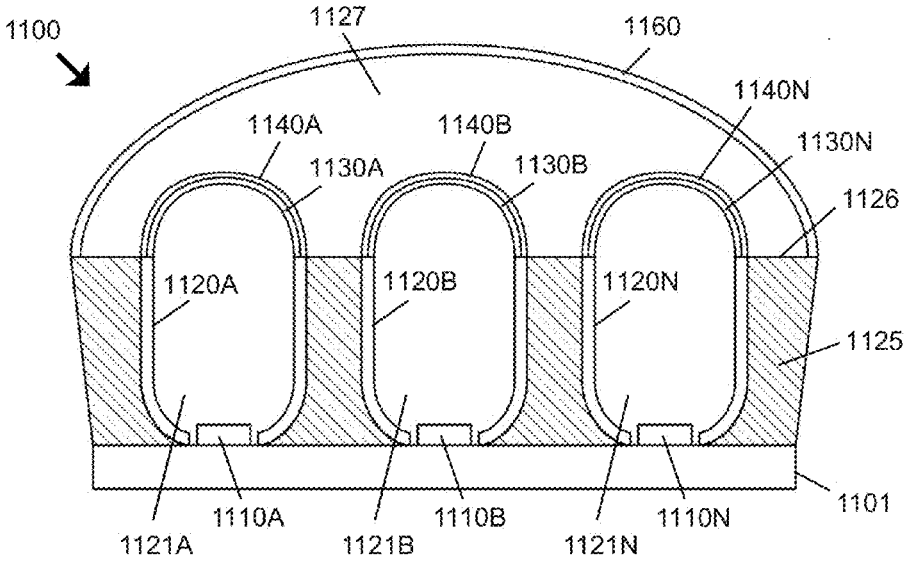
FIG. 11 is a side cross-sectional schematic view of a solid state lighting device according to one embodiment, including multiple LEDs arranged in multiple reflector cups and arranged to transmit light through multiple curved optical elements (e.g., optical filter or optical reflector, such a dichroic filter) to stimulate at least one lumiphoric material contained in multiple lumiphor elements that are spatially segregated from the LEDs, and including a diffuser or secondary optical element arranged to receive emissions of the multiple lumiphor elements.

FIG. 11 illustrates a solid state lighting device 1100 including multiple LEDs 1110A, 1110B, 1110N arranged in or on multiple reflector cups 1120A, 1120B, 1120N defining multiple reflector cavities 1121A, 1121B, 1121N. The LEDs 1110A, 1110B, 1110N may be supported by a substrate 1101. The reflector cups 1120A, 1120B, 1120N may be defined in a single body structure 1125 that may optionally be pre-manufactured (e.g., by molding, optionally followed by surface coating) and fitted over the substrate 1101 (e.g., following mounting of LEDs 1110A, 111B, 111N to the substrate 1101). In various embodiments, the reflector cups 1120A, 1120B, 1120N may be of the same size and shape; in other embodiments, the size and/or shape of individual reflector cups 1120A, 1120B, 1120N may be varies relative to one another. The body structure 1126 may include at least one secondary reflective structure or surface 1126 (e.g., above and/or around the reflector cups 1120A, 1120B, 1120N) to enclose at least a portion of a cavity 1127. Multiple (preferably curved or faceted) optical elements 1130A, 1130B, 1130N (e.g., each embodying an optical filter or optical reflector, such a dichroic filter) may be arranged over the multiple cavities 1121A, 1121B, 1121N, and arranged between the emitters 1110A, 1110B, 1110N and multiple (e.g., preferably curved or faceted) lumiphor elements 1140A, 1140B, 1140N further covering the multiple cavities 1121A, 1121B, 1121N and each including at least one lumiphoric material arranged to be stimulated by emissions by the LEDs 1110A, 1110B, 1110N. In certain embodiments, each lumiphor element 1140A, 1140B, 1140N may be arranged in contact with an optical element 1130A, 1130B, 1130N. Emissions that are transmitted through the optical elements 1130A, 1130B, 1130N impinge on at least one lumiphoric material contained in the lumiphor elements 1140A, 1140B, 1140N, which is spatially segregated from the LEDs 1110A, 1110B, 1110N. The optical elements 1130A, 1130B, 1130N are preferably arranged to prevent or reduce emissions from the at least one lumiphoric material from being transmitted into the reflector cavities 1121A, 1121B, 1121N, and instead to reflect such emissions in an outward direction toward a diffuser or secondary optical element 1160 (and preferably to exit the device 1100). The diffuser or secondary optical element 1160 may be arranged over a cavity 1127 and may be arranged to receive emissions from the lumiphor elements 1140A, 1140B, 1140N as well as any unabsorbed emissions of the LEDs 1110A, 1110B, 1110N transmitted through the lumiphor elements 1140A, 1140B, 1140N, and to diffuse and/or affect such emissions before exiting the lighting device 1100.

Certain embodiments as disclosed herein may include one or more (e.g., rear-facing) LEDs suspended in or above a reflector cavity, with LEDS arranged to emit light emissions toward a reflector element that is arranged to reflect at least a portion of the light emissions past the emitter support element for transmission through a curved optical element (e.g., optical filter or optical reflector, such a dichroic filter) to interact with the at least one lumiphor element.

Figure 12A:
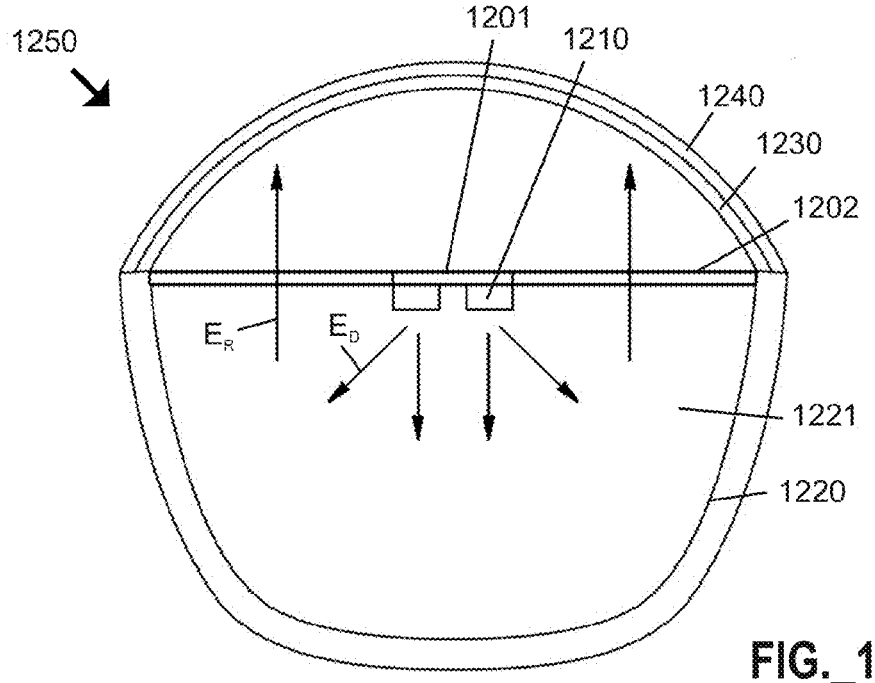
FIG. 12A is a side cross-sectional schematic view of a portion of a solid state lighting device according to one embodiment, including multiple LEDs suspended in or above a reflector cavity and supported by an emitter support element, with the LEDS arranged to emit light emissions toward a reflector element that is arranged to reflect at least a portion of the light emissions past the emitter support element for transmission through a curved optical element (e.g., optical filter or optical reflector, such a dichroic filter) to interact with the at least one lumiphor element.

FIG. 12A illustrates a portion 1250 of a solid state lighting device including one or more LEDs 1210 supported by an emitter support element 1201 suspended in a reflector cavity 1221 bounded by a reflector 1220. The emitter support element 1201 is held in place by cantilever supports 1202 that cover only a small portion of the cavity 1221, and that may also serve as conductive heat transfer elements. The cavity 1221 is further covered by optical element 1230 (preferably curved or faceted, and selected from the group consisting of optical filters and optical reflectors, such a dichroic filter) and a lumiphor element 1240 (preferably curved or faceted) including at least one lumiphoric material arranged to be stimulated by emissions of the LEDs 1210, with the optical element 1230 and lumiphor element 1240 being spatially segregated from the LEDs 1210.

Figure 12B:
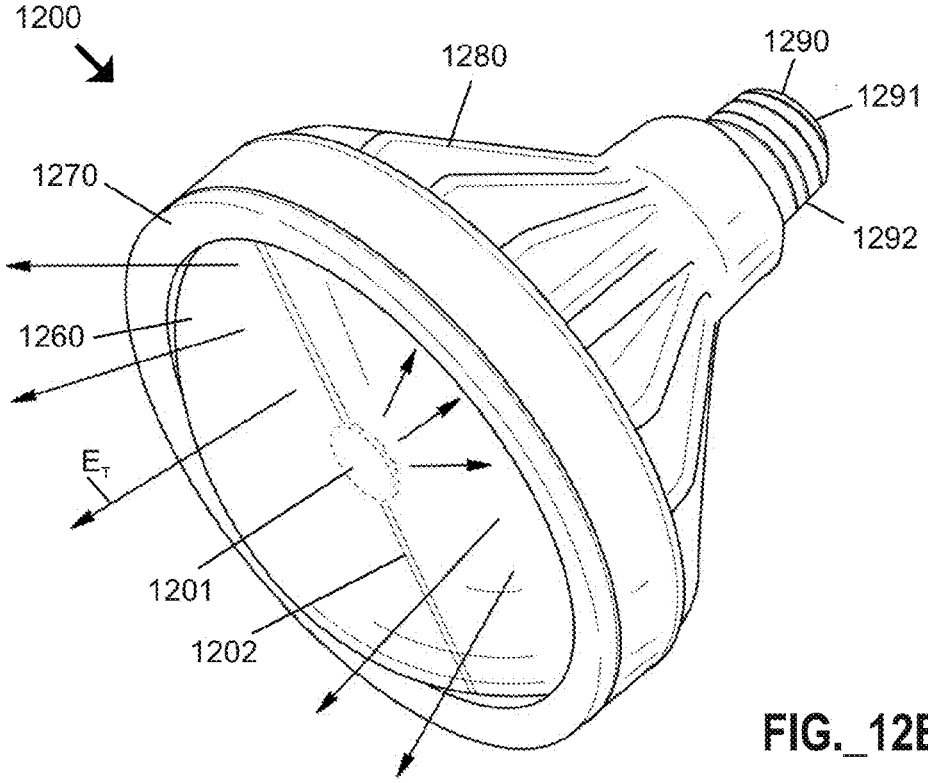
FIG. 12B is a perspective view of a solid state lighting device in the form of a light bulb including the device portion illustrated in FIG. 12A.

FIG. 12B is a perspective view of a solid state lighting device 1200 in the form of a light bulb including the device portion 1250 illustrated in FIG. 12A. A first, light emissive end 1260 (which may coincide with the lumiphor element 1240, or more preferably may include a lens or diffuser arranged over the lumiphor element 1240) is arranged along one end of the device 1200, with the opposing second, non-emissive end 1290 including electrical contacts 1291, 1292, which may be arranged as a foot contact and lateral contact, respectively, or any other suitable type of contacts. A finned heatsink 1280 may be arranged along a peripheral portion of the lighting device 1200 between the non-emissive end 1290 and an annular bezel 1270 optionally arranged proximate to the light emissive end 1260.

In operation of the lighting device 1200, electric current is supplied to the LEDs 1201 to generate direct emissions $E_D$ that are emitted in a rearward direction (i.e., toward the second, non-emissive end 1290) and reflected by the reflector element 1220 to form reflected emissions $E_R$ that are transmitted through the cavity 1221 past the emitter support element 1201 and cantilever supports 1202 to reach the optical element 1230. Such reflected emissions $E_R$ are preferably transmitted through the optical element 1230 to impinge on lumiphoric material contained in the lumiphor element 1240, which is spatially segregated from the LEDs 1210 and support elements 1201, 1202. The optical element 1230 is preferably arranged to prevent or reduce emissions from the at least one lumiphoric material from being transmitted into the reflector cavity 1221, and instead to reflect such emissions in an outward direction toward the light emissive end 1260 to exit the device 1200 as transmitted emissions $E_T$.

Figure 13:
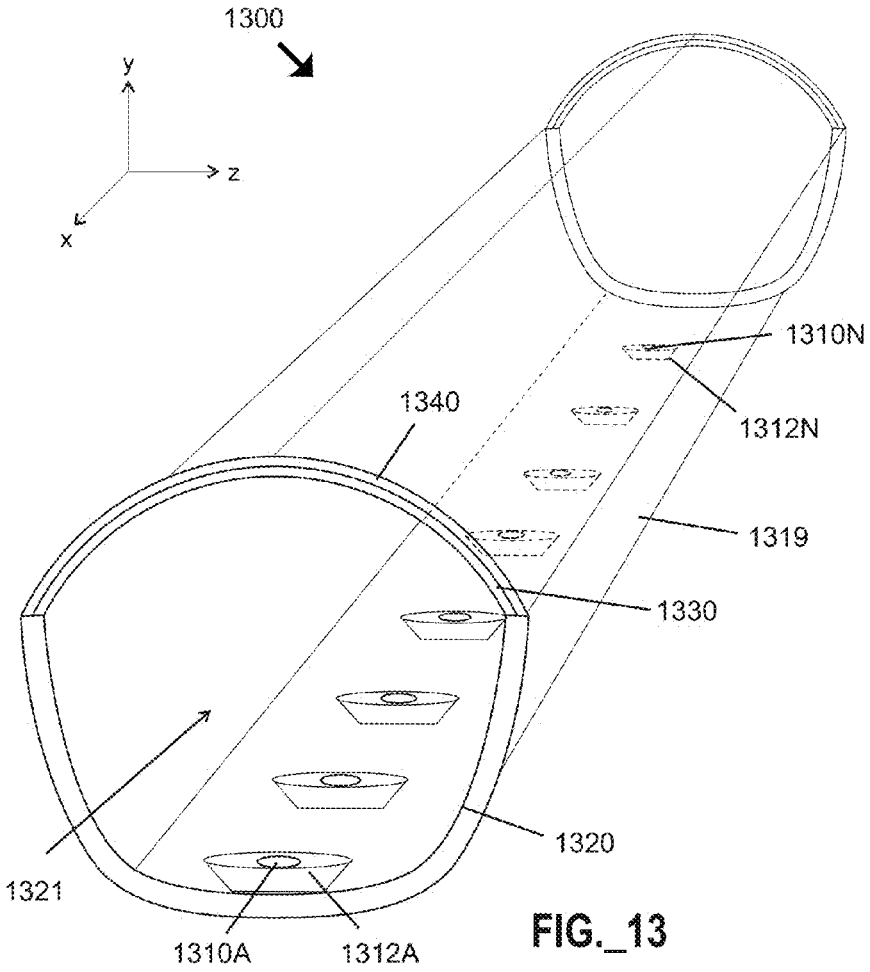
FIG. 13 is a perspective schematic view of a solid state lighting device according to one embodiment, including multiple LEDs arranged to transmit light through an curved optical element (e.g., optical filter or optical reflector, such a dichroic filter) to stimulate emissions of at least one lumiphoric material contained in an elongated lumiphor element, wherein the lighting device is configured as an elongated tube.

FIG. 13 illustrates at least a portion of an elongated solid state lighting device 1300 having a generally tubular shape. A body structure 1319 includes a reflective inner surface 1320 bounding a cavity 1321 containing multiple LEDs 1310A-1310N arranged within with individual reflector cups 1312A. The body structure 1319 may have an elongated length relative to width ratio (e.g., length to width ratio of at least about 5:1, 8:1, 10:1, 12:1, 15:1, 20:1, or another desired ratio). The LEDs 1310A-1310N may be supported by one or more substrates (not shown). The reflective surface 1320 extends above around portions of the individual reflector cups 1312A and the LEDs 1310A-1310N. A (preferably curved or faceted) optical element 1330 (e.g., optical filter or optical reflector, such a dichroic filter) may be arranged over at least a portion of the cavity 1321, and arranged between the cavity 1321 and a (preferably curved or faceted) lumiphor element 1340 including at least one lumiphoric material arranged to be stimulated by emissions of at least one of the LEDs 1310A-1310N. In operation, of the device 1300, emissions from the LEDs 1310A-1310N are emitted (and reflected by the reflector cups 1320A-1320N) into the cavity 1321 in a direction toward the optical element 1330 covering at least a portion of the reflector cavity 1321. The secondary reflective surface 1320 may reflect additional emissions (e.g., internal reflected emissions) toward the optical element 1330. Emissions that are transmitted through the optical element 1330 impinge on at least one lumiphoric material contained in the lumiphor element 1340, which is spatially segregated from the LEDs 1310. The optical element 1330 is preferably arranged to prevent or reduce emissions from the at least one lumiphoric material from being transmitted into the reflector cavity 1321, and instead to reflect such emissions in an outward direction to exit the lighting device 1300.

Although FIG. 13 depicts the LEDs 1310A-1310N as being arranged in individual reflector cups 1312A-1312N, it is to be appreciated that in certain embodiments the individual reflector cups 1312A-1312N may be omitted.

Figure 14:
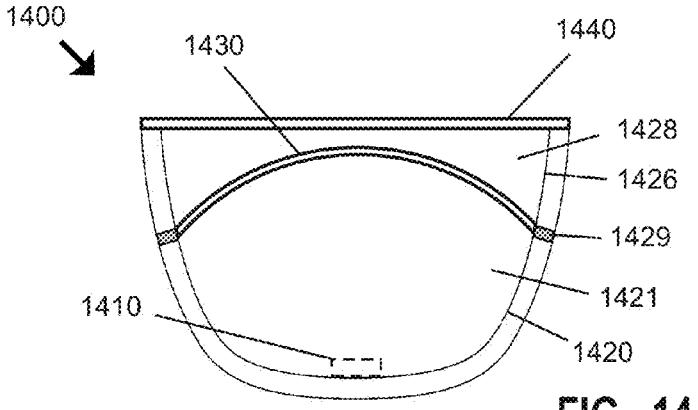
FIG. 14 is a side cross-sectional schematic view of a solid state lighting device according to one embodiment, including a LED mounted on or over a reflector element and arranged to transmit light through a curved or faceted optical element (e.g., optical filter or optical reflector, such a dichroic filter) to stimulate emissions of at least one lumiphoric material contained in a substantially flat or substantially planar lumiphor element that is spatially segregated from the LED.

In certain embodiments, a lighting device may include a curved or faceted (e.g, segmented with abutting non-coplanar segments) optical element in combination with at least one lumiphor material arranged in a substantially planar (e.g., flat) lumiphor element. An example of such a structure is shown in FIG. 14, which depicts a solid state lighting device 1400 including a LED 1410 arranged on or in a first reflector element 1420 bounding a cavity 1421, with a curved or faceted optical element 1430 (e.g., optical filter or optical reflector, such a dichroic filter) arranged in or over the cavity 1421. A second reflector element 1426 (which may be affixed to the first reflector element 1420 at an interface 1429) may be arranged around a periphery of the optical element 1430 and extending between the optical element 1430 and a substantially planar lumiphor element 1440. The lumiphor element 1440 and the curved or faceted optical element 1430 may be separated by a gap or intervening (e.g., transmissive) material 1428, which may be a solid or fluid material. In operation of the device 1400, the LED is arranged to emit light emissions into the cavity 1421, with the reflector 1420 being arranged to direct light toward (and through) the optical element 1430 to impinge on the lumiphor element 1440 to stimulate emissions by lumiphoric material contained in the lumiphor element 1440. Any lumiphor emissions emitted into the gap or intervening material 1428 are preferably reflected by the optical element 1430 back toward the lumiphor element 1440, preferably to exit the lighting device 1440.

Figure 15:
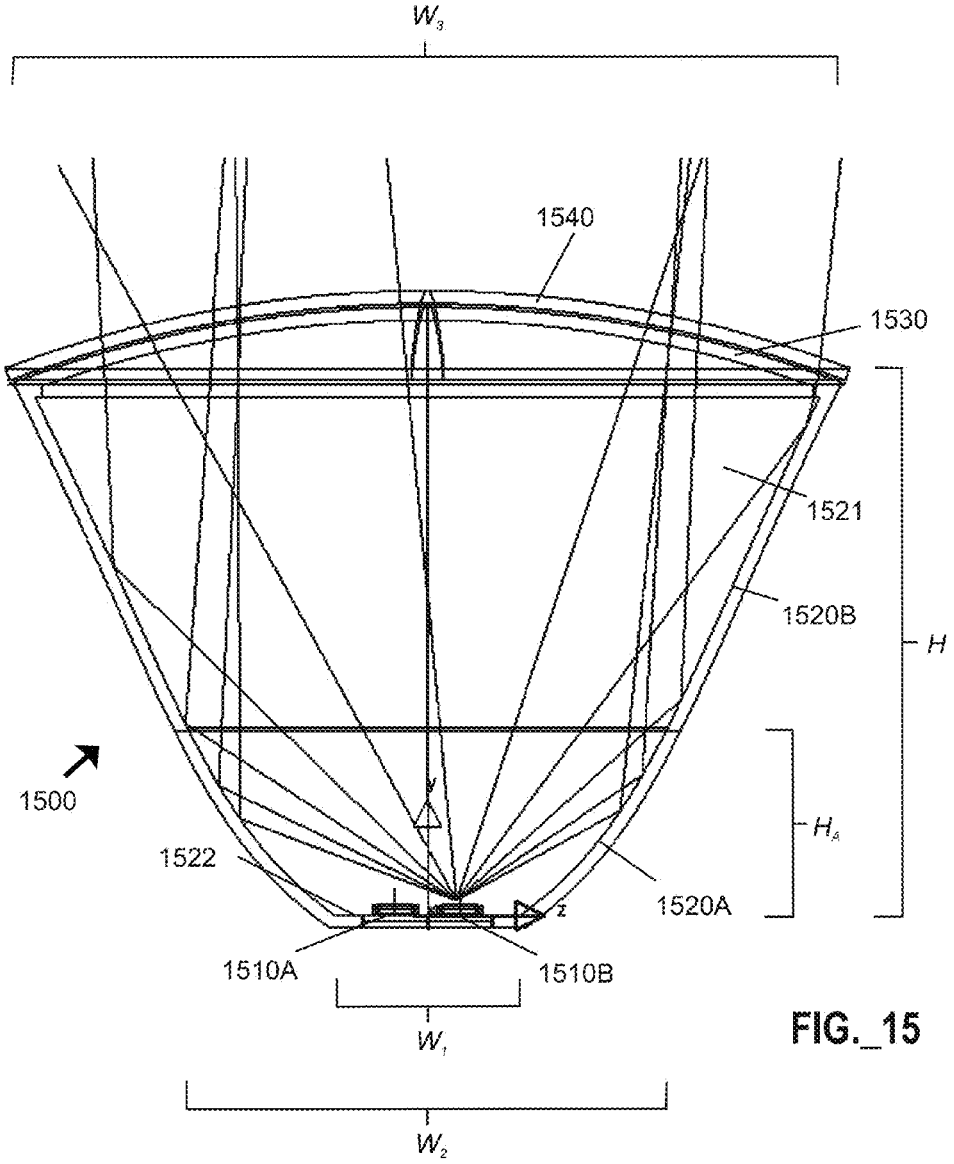
FIG. 15 is a cross-sectional schematic view of a solid state lighting device according to one embodiment, including multiple LEDs mounted on or over a cup-shaped reflector element and arranged to transmit light through a curved optical element (e.g., optical filter or optical reflector, such a dichroic filter) to stimulate emissions of at least one lumiphoric material contained in a curved lumiphor element, including traces (obtained by computer modeling) of reflected and transmitted beams emitted by one LED.

FIG. 15 illustrates a solid state lighting device 1500 according to one embodiment, including multiple LEDs 1510A, 1510B mounted on or over a cup-shaped reflector element 1520 (consisting of curved wall reflector portion 1520A and straight wall reflector portion 1520) and arranged to transmit light through a curved or faceted optical element 1530 (e.g., optical filter or optical reflector, such a dichroic filter) to stimulate emissions of at least one lumiphoric material contained in a curved or faceted lumiphor element 1540. FIG. 15 further includes (obtained by computer modeling) of reflected and transmitted beams emitted by one LED 1510. Elements within FIG. 15 are represented as being to scale relative to one another. Relative to a hypothetical width $W_1$ of a base portion 1522 of the reflector element 1520, each LED 1510A, 1510B has a width that is about one fourth of $W_1$; the curved wall reflector portion 1520 (proximate to the base portion 1522) has a height $H_A$ that is about equal to $W_1$; the entire reflector 1520 has a height H that is about 3 times $W_1$; the reflector has a maximum width W3 that is about 3 times $W_1$; and the optical element has a radius of curvature that is about 6.2 times $W_1$. As shown in FIG. 15, beams exiting the lighting device 1500 at angles generally between about 60-90 degrees relative to a top surface of each LED 1510A, 15108.

Embodiments as disclosed herein may provide one or more of the following beneficial technical effects: permitting an increased proportion of LED emissions to interact with an optical element at or near a 90 degree angle of incidence, thereby providing reduced attenuation (e.g., reflection) of such emissions by the optical element; providing increased luminous efficacy of lumiphor-converted solid state lighting devices; providing increased energy efficiency of lumiphor-converted solid state lighting devices; enhancing configuration flexibility of solid state lighting devices; and reduced cost of fabrication.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Various combinations and sub-combinations of the structures described herein are contemplated and will be apparent to a skilled person having knowledge of this disclosure. Any of the various features and elements as disclosed herein may be combined with one or more other disclosed features and elements unless indicated to the contrary herein. Correspondingly, the invention as hereinafter claimed is intended to be broadly construed and interpreted, as including all such variations, modifications and alternative embodiments, within its scope and including equivalents of the claims.

What is claimed is:

1. A lighting device comprising:

at least one electrically activated solid state emitter;

at least one lumiphoric material spatially segregated from the at least one electrically activated solid state emitter, and arranged to receive at least a portion of emissions from the at least one electrically activated solid state emitter and responsively generate lumiphor emissions;

at least one optical element, selected from the group consisting of optical filters and optical reflectors, arranged between the at least one electrically activated solid state emitter and the at least one lumiphoric material, wherein at least a portion of the at least one optical element is curved or faceted; and at least one reflector element comprising at least one recess, trough, or cup, and arranged to reflect emissions from the at least one electrically activated solid state emitter toward the at least one optical element;

wherein the at least one optical element is configured to enable passage of a first wavelength range, at least a portion of emissions of the at least one electrically activated solid state emitter being within the first wavelength range;

wherein the at least one optical element is configured to filter or reflect at least a portion of a second wavelength range, at least a portion of the lumiphor emissions being within the second wavelength range, the at least one optical element thereby preventing the at least a portion of the lumiphor emissions from being transmitted toward the at least one electrically activated solid state emitter; and wherein the first wavelength range differs from the second wavelength range.

2. A lighting device according to claim 1, wherein the at least one optical element spans a solid angle of less than or equal to $2\pi$ steradians.

3. A lighting device according to claim 1, wherein the at least one optical element comprises a dichroic filter.

4. A lighting device according to claim 1, wherein at least a portion of the at least one optical element is faceted.

5. A lighting device according to claim 1, wherein at least a portion of the at least one reflector element is faceted.

6. A lighting device according to claim 1, wherein the at least one reflector element is specularly reflective.

7. A lighting device according to claim 1, wherein the at least one lumiphoric material is arranged in a lumiphor element disposed in contact with the at least one optical element.

8. A lighting device according to claim 1, wherein the at least one electrically activated solid state emitter comprises multiple electrically activated solid state emitters.

9. A lighting device according to claim 1, wherein the at least one optical element comprises at least one of an interference filter or an interference reflector.

10. A lighting device comprising:

multiple electrically activated solid state emitters;

a lumiphor element spatially segregated from the multiple electrically activated solid state emitters, and arranged to receive at least a portion of emissions from the multiple electrically activated solid state emitters and responsively generate lumiphor emissions;

an optical element, selected from the group consisting of optical filters and optical reflectors, arranged between the multiple electrically activated solid state emitters and the lumiphor element; and at least one reflector element arranged to reflect emissions from the multiple electrically activated solid state emitters toward the optical element;

wherein the lighting device comprises at least one of the following features (A) or (B):

(A) the optical element comprises a nonzero thickness that varies with respect to angular position along at least a portion of the optical element arranged to receive emissions generated by the multiple electrically activated solid state emitters; or (B) the lumiphor element comprises at least one of the following characteristics (i) to (iv) that varies with respect to angular position along at least a portion of the lumiphor element arranged to receive emissions transmitted through the optical element: (i) nonzero thickness of the lumiphor element; (ii) nonzero concentration of lumiphoric material; (iii) nonzero amount of lumiphoric material; or (iv) composition of lumiphoric material.

11. A lighting device according to claim 10, wherein the optical element comprises a nonzero thickness that varies with respect to angular position along at least a portion of the optical element arranged to receive emissions generated by the multiple electrically activated solid state emitters.

12. A lighting device according to claim 10, wherein the lumiphor element comprises at least one of the following characteristics (i) to (iv) that varies with respect to angular position along at least a portion of the lumiphor element arranged to receive emissions transmitted through the optical element: (i) nonzero thickness of the lumiphor element; (ii) nonzero concentration of lumiphoric material; (iii) nonzero amount of lumiphoric material; or (iv) composition of lumiphoric material.

13. A lighting device according to claim 10, comprising both features (A) and (B).

14. A lighting device according to claim 10, wherein at least a portion of the optical element is curved or faceted.

15. A lighting device according to claim 10, wherein the at least one reflector element comprises multiple recesses or cups arranged to reflect emissions from the multiple electrically activated solid state emitters toward the optical element.

16. A lighting device according to claim 10, wherein at least a portion of the at least one reflector element is curved or faceted.

17. A lighting device according to claim 10, wherein the at least one reflector element is specularly reflective.

18. A lighting device according to claim 10, wherein the optical element comprises a dichroic filter.

19. A lighting device according to claim 10, further comprising a diffuser arranged to diffuse emissions generated by the multiple electrically activated solid state emitters and the lumiphor element.

20. A lighting device according to claim 10, wherein:

the optical element is configured to enable passage of a first wavelength range, at least a portion of emissions of the multiple electrically activated solid state emitters being within the first wavelength range;

the optical element is configured to filter or reflect at least a portion of a second wavelength range, at least a portion of the lumiphor emissions being within the second wavelength range, the optical element thereby preventing the at least a portion of the lumiphor emissions from being transmitted toward the multiple electrically activated solid state emitters; and the first wavelength range differs from the second wavelength range.

21. A lighting device according to claim 10, wherein the optical element comprises at least one of an interference filter or an interference reflector.

22. A lighting device according to claim 10, wherein the at least one reflector element comprises at least one recess, trough, or cup.

* * * * *